US011173511B2

(12) United States Patent
Thompson et al.

(10) Patent No.: US 11,173,511 B2
(45) Date of Patent: Nov. 16, 2021

(54) SYSTEMS FOR AUTOMATED MOBILE PAINTING OF STRUCTURES

(71) Applicant: Graco Minnesota Inc., Minneapolis, MN (US)

(72) Inventors: David J. Thompson, Oak Grove, MN (US); Jon M. Knutson, Maple Grove, MN (US); Dale D. Johnson, Shoreview, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 84 days.

(21) Appl. No.: 16/478,389

(22) PCT Filed: Jan. 17, 2018

(86) PCT No.: PCT/US2018/014027

§ 371 (c)(1),
(2) Date: Jul. 16, 2019

(87) PCT Pub. No.: WO2018/136499

PCT Pub. Date: Jul. 26, 2018

(65) Prior Publication Data

US 2019/0374966 A1 Dec. 12, 2019

Related U.S. Application Data

(60) Provisional application No. 62/447,426, filed on Jan. 17, 2017, provisional application No. 62/474,592, filed on Mar. 21, 2017.

(51) Int. Cl.
*B05B 13/04* (2006.01)
*B05B 9/00* (2006.01)
(Continued)

(52) U.S. Cl.
CPC ..... *B05B 13/041* (2013.01); *B05B 9/007* (2013.01); *B05B 12/124* (2013.01); *B05B 15/534* (2018.02);
(Continued)

(58) Field of Classification Search
CPC ..... B05B 13/041; B05B 9/007; B05B 12/124; B05B 15/534; B05B 1/26; B05B 13/005;
(Continued)

(56) References Cited

U.S. PATENT DOCUMENTS 1,440,147 A 12/1922 Heinrich
3,219,276 A 11/1965 Norris
(Continued)

FOREIGN PATENT DOCUMENTS

CN 201826508 U 5/2011
CN 203008337 U 6/2013
(Continued)

OTHER PUBLICATIONS

First Chinese Office Action for CN Application No. 2018800071408, dated Oct. 13, 2020, p. 28.
(Continued)

*Primary Examiner* — Laura Edwards
(74) *Attorney, Agent, or Firm* — Kinney & Lange, P. A.

(57) ABSTRACT

An automated mobile sprayer (AMS) includes a mobile base, an applicator arm supported by the mobile base, and a nozzle extending from the applicator arm. The nozzle receives fluid from a fluid supply and generates an atomized fluid spray for application to a surface. The applicator arm moves vertically relative to the mobile base and the surface to cause the nozzle to generate a vertical fluid stripe. The mobile base moves laterally relative to the surface to cause the nozzle to generate a horizontal fluid stripe.

24 Claims, 9 Drawing Sheets

(51) Int. Cl.

| | |
|---|---|
| ***B05B 12/12*** | (2006.01) |
| ***B05B 15/534*** | (2018.01) |
| ***B05C 5/02*** | (2006.01) |
| ***B05C 11/10*** | (2006.01) |

(52) U.S. Cl.
CPC ..... *B05C 5/0291* (2013.01); *B05C 11/1018* (2013.01)

(58) Field of Classification Search
CPC ..... B05B 9/0413; B05B 9/042; B05B 12/006; B05C 5/0225; B05C 5/0291; B05C 11/1018; B05C 11/1026
USPC ..... 118/300, 323; 239/225.1–265
See application file for complete search history.

(56) References Cited

U.S. PATENT DOCUMENTS

| | | | | |
|---|---|---|---|---|
| 3,274,860 | A | | 9/1966 | Gauthier et al. |
| 3,863,393 | A | | 2/1975 | Goff |
| 4,048,956 | A | | 9/1977 | Estebanez et al. |
| 4,838,492 | A | | 6/1989 | Berry |
| 5,358,568 | A | * | 10/1994 | Okano ..... B05B 13/005 118/323 |
| 5,419,734 | A | | 5/1995 | Van Sickle |
| 5,901,720 | A | | 5/1999 | Lange |
| 5,935,657 | A | | 8/1999 | Melendez |
| 6,544,336 | B1 | | 4/2003 | Lopes |
| 8,298,347 | B2 | | 10/2012 | MacNeil et al. |
| 9,302,286 | B2 | | 4/2016 | Morton |
| 9,393,594 | B2 | | 7/2016 | Logan et al. |
| 10,124,359 | B2 | | 11/2018 | Raman et al. |
| 2007/0000442 | A1 | | 1/2007 | Schucker |
| 2008/0251010 | A1 | | 10/2008 | Atwood |
| 2010/0143089 | A1 | | 6/2010 | Hvass et al. |
| 2017/0080438 | A1 | | 5/2017 | Storr |
| 2018/0281012 | A1 | | 10/2018 | Telleria et al. |
| 2019/0388926 | A1 | | 12/2019 | Raman et al. |

FOREIGN PATENT DOCUMENTS

| | | | |
|---|---|---|---|
| CN | 104131686 | A | 11/2014 |
| CN | 104343230 | A | 2/2015 |
| EP | 3549677 | A1 | 10/2019 |
| JP | 59109272 | A | 6/1984 |
| JP | 62079865 | A | 4/1987 |
| JP | 63069559 | A | 3/1988 |
| JP | 09271698 | A | 10/1997 |
| KR | 20050020335 | A | 3/2005 |
| KR | 100699129 | B1 | 3/2007 |
| WO | WO9820982 | A1 | 5/1998 |
| WO | WO9834734 | A1 | 8/1998 |
| WO | WO 2017145183 | A1 | 8/2017 |

OTHER PUBLICATIONS

Extended European Search Report for EP Application No. 18741037.8, dated Oct. 1, 2020, p. 8.
International Search Report and Written Opinion for PCT application No. PCT/US2018/014027 dated May 9, 2018, 40 pages.
International Preliminary Report on Patentability for PCT Application No. PCT/US2018/014027, dated Aug. 1, 2019, p. 36.
Second Chinese Office Action for CN Application No. 2018800071408, dated Jul. 5, 2021, p. 20.

* cited by examiner

SYSTEMS FOR AUTOMATED MOBILE PAINTING OF STRUCTURES

CROSS-REFERENCE TO RELATED APPLICATION(S)

This application claims priority to U.S. Provisional Application No. 62/447,426 filed Jan. 17, 2017, and entitled "UNMANNED AERIAL VEHICLE FOR PAINTING STRUCTURES," and to U.S. Provisional Application No. 62/474,592 filed Mar. 21, 2017, and entitled "SYSTEMS FOR AUTOMATED MOBILE PAINTING OF STRUCTURES," the disclosures of which are hereby incorporated in their entirety.

BACKGROUND

This disclosure relates generally to mobile fluid spraying systems. More specifically, this disclosure relates to automated mobile painting systems.

Fluid spray systems produce an atomized fluid spray fan and apply the spray fan to a surface. The spray fan is typically in a horizontal orientation or a vertical orientation. In the horizontal orientation the fan is swept across the surface in vertical passes. In the vertical orientation the fan is swept across the surface in horizontal passes. As such, the spray fan is oriented orthogonal to the sweep direction. Typically, a user operates a spray gun to apply the fluid to the surface.

Automated painting systems are typically used to paint components, such as doors and panels. The autonomous painting systems utilize a robotic arm that moves through three-dimensional space to apply paint to the component. The robotic arms are complex and require multiple joints to provide the degree of freedom necessary to coat the components. Moreover, the robotic arm requires the component to move to a position where the arm can reach the component, as a base of the robotic arm is fixed on a factory floor.

SUMMARY

According to one aspect of the disclosure, an automated mobile sprayer for spraying a fluid on a wall includes a mobile base including a plurality of wheels or tracks and one or more motors configured to move the mobile base via the plurality of wheels or tracks; an applicator arm supported on the base, the applicator arm movable along a vertical axis; a spray tube extending from the applicator arm; a nozzle mounted on the spray tube and configured to spray the fluid; a fluid supply fluidly connected to the nozzle and configured to supply fluid to the nozzle; and a controller configured to control a sweep of the nozzle relative to the wall and to control spray of the fluid from the nozzle. The spray tube extends from the applicator arm beyond an edge of the mobile base such that the nozzle is not located directly over the mobile base. One or both of (1) the applicator arm is configured to displace along the vertical axis and the mobile base is configured to remain stationary during a vertical fluid stripe application, and (2) the mobile base is configured to displace along a lateral axis and the applicator arm is configured to remain stationary relative to the mobile base during a horizontal fluid stripe application.

According to another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the base, the applicator arm movable along a vertical axis; a nozzle connected to the applicator arm and configured to generate a spray of the fluid; a fluid supply fluidly connected to the nozzle and configured to supply the fluid to the nozzle; and a controller configured to control the mobile base and the applicator arm to execute a plurality of sweeps of the nozzle relative to the wall while spraying the fluid from the nozzle. To start each sweep of the plurality of sweeps, the controller is configured to initiate motion of the sweep of the nozzle prior to initiating spraying from the nozzle such that the nozzle is already in the sweep motion when the spray from the nozzle starts.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the base, the applicator arm movable along a vertical axis; a nozzle coupled to the applicator arm and configured to spray the fluid; a fluid supply fluidly connected to the nozzle and configured to supply the fluid to the nozzle; an inertial sensor supported by the applicator arm, the inertial sensor configured to generate a signal based on a sensed acceleration; and a controller configured to control a sweep of the nozzle relative to a surface and to control spray generation at the nozzle based on the signal.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the base, the applicator arm movable along a vertical axis; a nozzle connected to the applicator arm and configured to spray the fluid; a first sensor supported by the applicator arm and configured to sense a first distance, the first distance being a distance between the wall and the first sensor; a second sensor supported by the applicator arm and configured to sense a second distance, the second distance being a distance between the wall and the second sensor; a fluid supply fluidly connected to the nozzle and configured to supply the fluid to the nozzle; and a controller configured to control a sweep of the nozzle relative to the wall and to control spraying of the fluid from the nozzle based on at least one of the first distance and the second distance.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the base, the applicator arm movable along a vertical axis; a spray tube extending from the applicator arm; a nozzle fluidly connected to the spray tube, the nozzle configured to spray the fluid; a linear actuator attached to the spray tube, the linear actuator configured to extend the spray tube relative to the applicator arm to move the nozzle closer to the wall, and further retract the spray tube relative to the applicator arm to move the nozzle away from the wall; a fluid supply fluidly connected to the nozzle and configured to supply the fluid to the nozzle; and a controller configured to control a sweep of the nozzle relative to the wall and spray from the nozzle.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the base, the applicator arm movable along a vertical axis; a nozzle fluidly connected to the applicator arm and configured to spray the fluid; a fluid supply fluidly connected to the nozzle and configured to supply the fluid to the nozzle; a de-clog mechanism connected to the applicator arm; and a controller configured to control spraying of the fluid. The nozzle includes a rotatable barrel extending into a tip bore; and an orifice disposed within the rotatable tip barrel, the orifice including a first end and a second end. The de-clog mechanism is configured to rotate the spray tip between a spray position in which the fluid is ejected from the nozzle through the first end of the orifice to spray out of the nozzle, and a de-clog positon in which the fluid is ejected from the nozzle through the second end of the orifice to de-clog the nozzle.

According to yet another aspect of the disclosure, an automated mobile spray system includes a mobile base comprising a plurality of wheels or tracks and one or more motors configured to move the mobile base via the plurality of wheels or tracks; an applicator arm supported on the base; a nozzle connected to the applicator arm and configured to spray the fluid; a fluid supply fluidly connected to the nozzle and configured to supply the fluid to the nozzle; a sensor configured to generate a parameter indicative of the nozzle being clogged; and a controller configured to detect a clog in the nozzle based on the parameter, and to stop the flow of the fluid through the nozzle based on the detection of the clog.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the mobile base, the applicator arm movable along a vertical axis; a nozzle connected to the applicator arm, the nozzle configured to spray a fan of the fluid, the fan having a width and a thickness, the width being greater than the thickness; a fan rotating assembly configured to rotate the nozzle; a fluid supply fluidly connected to the nozzle and configured to supply fluid to the nozzle; and a controller configured to control motion of the nozzle relative to the wall to spray a horizontal stripe by moving the nozzle horizontally and a vertical stripe by moving the nozzle vertically. The fan rotating assembly is configured to rotate the nozzle relative to the applicator arm between a vertical spray fan orientation in which the width is vertically orientated for the horizontal stripe and a horizontal spray fan orientation in which the width is horizontally orientated for the vertical stripe.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the mobile base, the applicator arm movable along a vertical axis; a nozzle connected to the applicator arm, the nozzle configured to spray a fan of the fluid; a pump configured to supply fluid to the nozzle under pressure; and a controller configured to control a plurality of overlapping and offset parallel sweeps of the nozzle relative to the wall and to control spraying from the nozzle. The controller is configured to control the offset positioning of the nozzle for the plurality of parallel sweeps based on an overlap parameter.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the mobile base, the applicator arm movable along a vertical axis; a roller assembly mounted on the applicator arm; a pump; and a controller configured to control a sweep of the applicator arm relative to a surface. The roller assembly includes a roller arm extending from the applicator arm; a fluid roller disposed at an end of the roller arm opposite the applicator arm; and a biasing mechanism that allows relative movement of the fluid roller towards and away from the applicator arm while maintaining compression of the fluid roller on the wall. The pump is configured to supply fluid to the fluid roller.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the mobile base, the applicator arm movable along a vertical axis; a nozzle fluidly connected to the applicator arm, the nozzle configured to generate a spray fan of fluid; a fluid supply fluidly connected to the nozzle and configured to supply the fluid to the nozzle; a sensor configured to measure a parameter of the fluid; and a controller configured to control a sweep speed of the applicator arm based on the measurement of the parameter.

According to yet another aspect of the disclosure, an automated mobile sprayer includes a mobile base, an applicator arm supported on the mobile base and movable along a vertical axis, a spray tube extending from the applicator arm, a nozzle fluidly connected to the spray tube and configured to generate a spray fan of fluid, a fluid supply fluidly connected to the nozzle and configured to supply fluid to the nozzle, an optical sensor supported by the applicator arm and configured to monitor the spray fan and generate a spray fan image, and a controller configured to control a sweep of the nozzle relative to a surface, and wherein the controller is configured to control spray generation at the nozzle based on the spray fan image and to calculate an actual spray fan width based on the spray fan image.

According to yet another aspect of the disclosure, a method of applying fluid to a surface includes generating a spray fan of fluid through a nozzle; sweeping the nozzle relative to the surface; monitoring the spray fan with an optical sensor supported on an applicator arm through which the nozzle extends, the optical sensor generating a spray fan image; calculating an actual spray fan width based on the spray fan image; and comparing the actual spray fan width to a desired spray fan width.

According to yet another aspect of the disclosure, a method of applying a fluid to a surface includes generating a spray fan of fluid through a nozzle the nozzle extending from an applicator arm supported by a frame mounted on a mobile base, the applicator arm capable of vertical movement relative to the mobile base and the surface; sweeping the nozzle relative to the surface; monitoring a plurality of spray parameters; and maintaining a first one of the plurality of spray parameters constant by adjusting a second one of the plurality of spray parameters.

According to yet another aspect of the disclosure, a method of removing a tip clog from a nozzle includes sensing a clog while spraying; stopping spray through a nozzle; moving a screen to a blocking position where the screen is disposed between the nozzle and a surface being sprayed, such that any spray out of nozzle is deposited on the screen; rotating a rotatable tip of the nozzle from a spray position to a de-clog position; resuming spraying through the nozzle with the rotatable tip in the de-clog position and the screen in the blocking position; stopping the resumed spray through the nozzle; rotating the rotatable tip of the nozzle to the spray position from the de-clog position; moving the screen to a retracted position where the screen is not disposed between the nozzle and the surface; and resuming spraying through the nozzle with the rotatable tip in the spray position and the screen in the retracted position.

According to yet another aspect of the disclosure, a method of detecting and removing a tip clog includes generating a spray fan of fluid through a nozzle; monitoring, with a sensor, a spray parameter for a variation indicative of a tip clog in the nozzle; initiating a de-clog routine based on sensing the variation indicative of the tip clog; and resuming generation of the spray fan of fluid through the nozzle. The de-clog routine includes stopping spray through the nozzle; rotating a rotatable tip of the nozzle from a spray position to a de-clog position; resuming spraying through the nozzle; monitoring the spray parameter for a variation indicative of a clog removal from the nozzle; stopping spray through the nozzle based on sensing the variation indicative of a clog removal; and rotating the rotatable tip of the nozzle to the spray position from the de-clog position.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the base, the applicator arm movable along a vertical axis; a nozzle supported by the applicator arm and configured to spray the fluid; a fluid supply fluidly connected to the nozzle and configured to supply fluid to the nozzle; a controller configured to control spray from the nozzle; and a motorized screen mounted on the applicator arm, the motorized screen movable between a spraying position in which the screen is not disposed between the nozzle and the wall such that spraying the fluid on the wall from the nozzle is permitted, and a blocking position in which the screen is disposed between the nozzle and the wall to block the fluid released from the nozzle from being sprayed on the wall.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the base, the applicator arm movable along a vertical axis; a nozzle supported by the applicator arm and configured to spray the fluid; a fluid supply fluidly connected to the nozzle and configured to supply fluid to the nozzle; a sensor configured to sense a spray parameter during spraying; and a controller in communication with the sensor, the controller configured to control spray from the nozzle and to stop spraying based on a change in the parameter.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the base, the applicator arm movable along a vertical axis; a nozzle supported by the applicator arm and configured to spray the fluid; a fluid supply fluidly connected to the nozzle and configured to supply fluid to the nozzle; a distance sensor supported by the applicator arm and configured to sense a distance between the wall and the distance sensor; a fluid supply fluidly connected to the nozzle and configured to supply the fluid to the nozzle; and a controller configured to control spray from the nozzle and to adjust a spray parameter based on the sensed distance.

According to yet another aspect of the disclosure, an automated mobile sprayer for spraying a fluid on a wall includes a mobile base comprising a plurality of wheels or tracks and one or more motors configured to move the mobile base via the plurality of wheels or tracks; an applicator arm supported on the base, the applicator arm movable along a vertical axis; a nozzle supported by the applicator arm and configured to spray the fluid; a controller configured to control spray from the nozzle; and a fluid supply fluidly connected to the nozzle and configured to supply fluid to the nozzle. The fluid supply includes a pump disposed off-board of the mobile base and a supply hose extending between the pump to the applicator arm to supply the fluid to the applicator arm.

Each of the above aspects can be implemented individually and separately from the other aspects of this summary and the other aspects and embodiments referenced elsewhere in this disclosure.

DETAILED DESCRIPTION

Figure 1A:
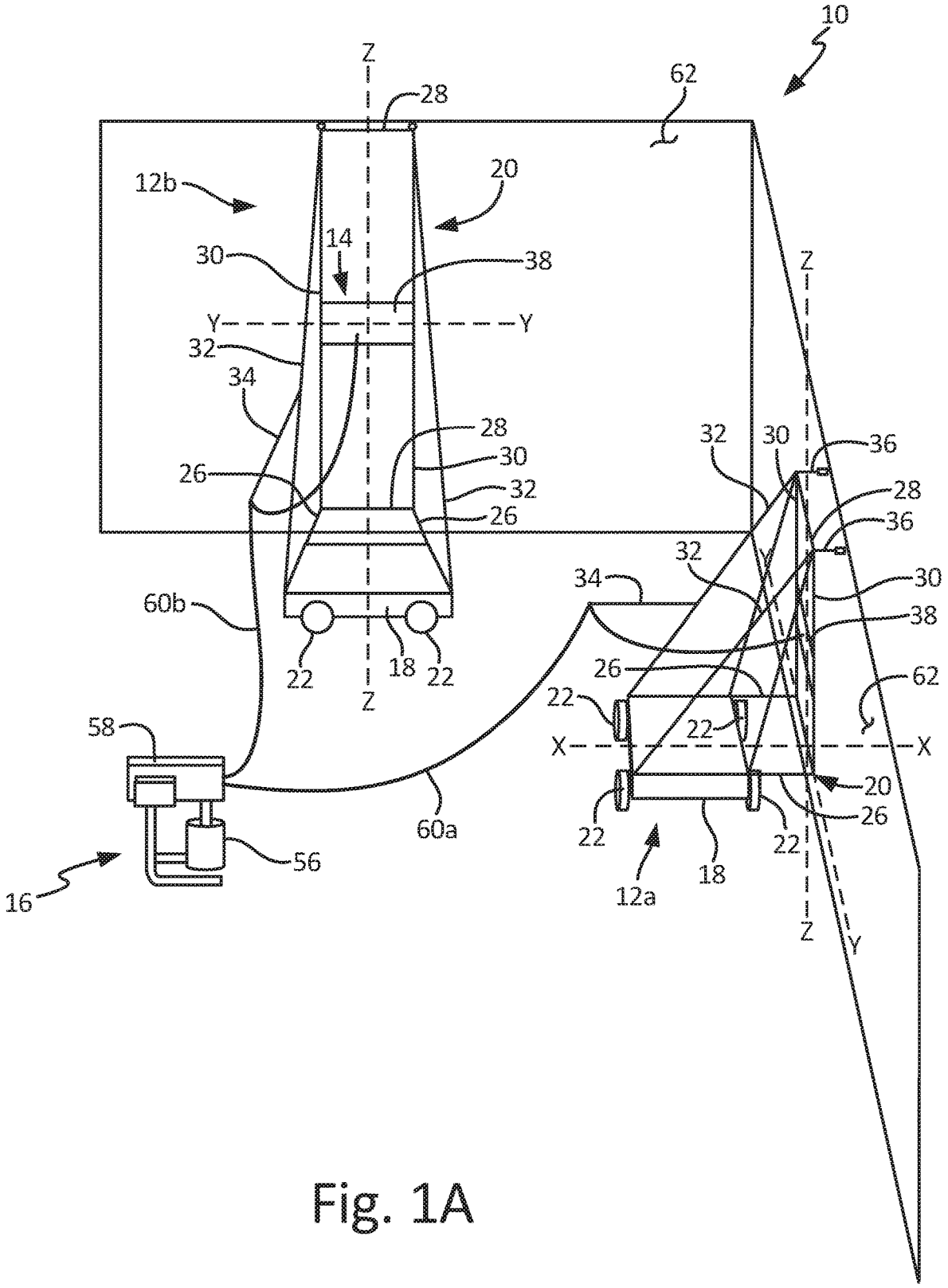
FIG. 1A is an isometric view of an automated mobile spray system.
Figure 1B:
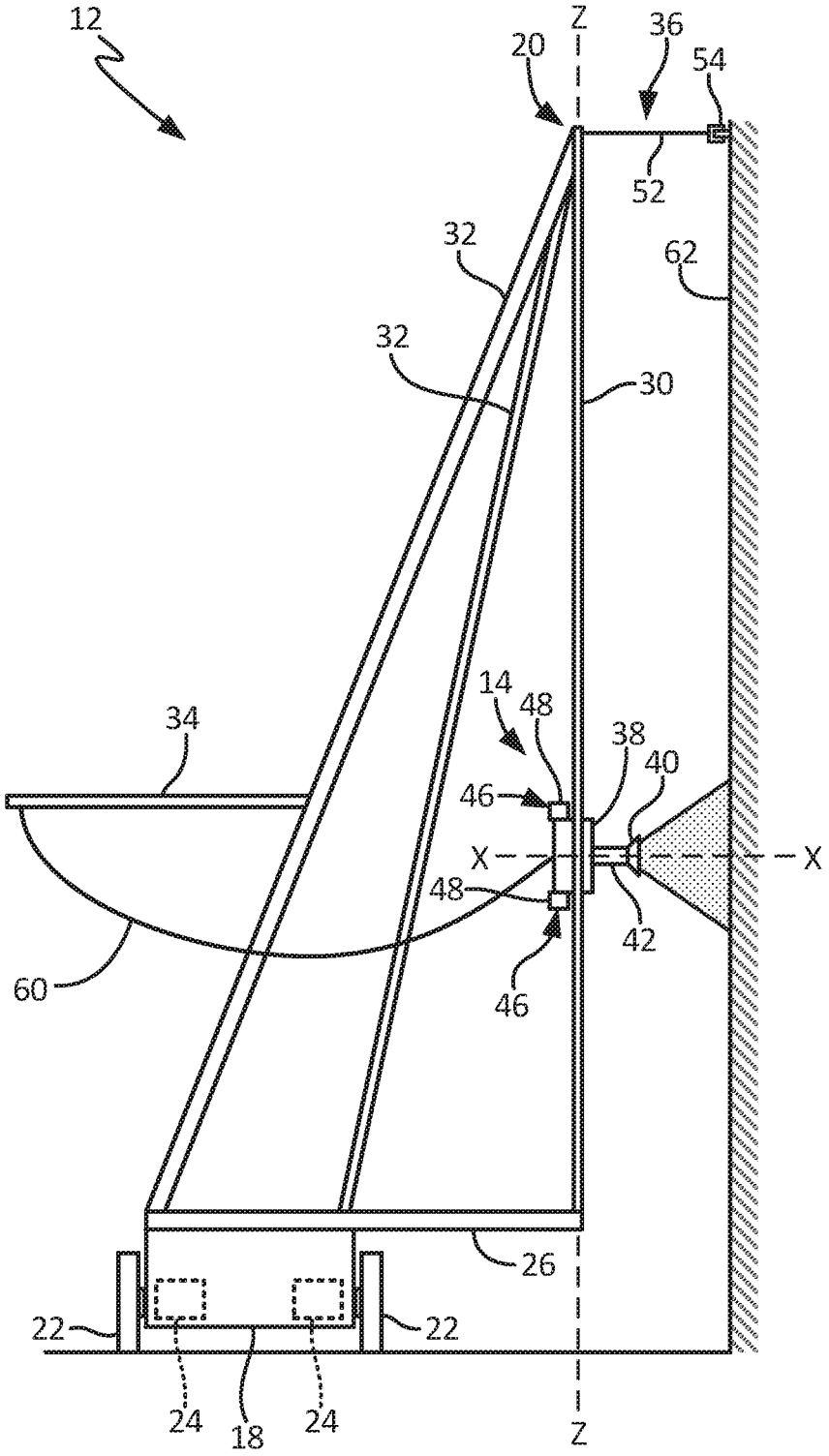
FIG. 1B is a side elevation view of an automated mobile sprayer.
Figure 1C:
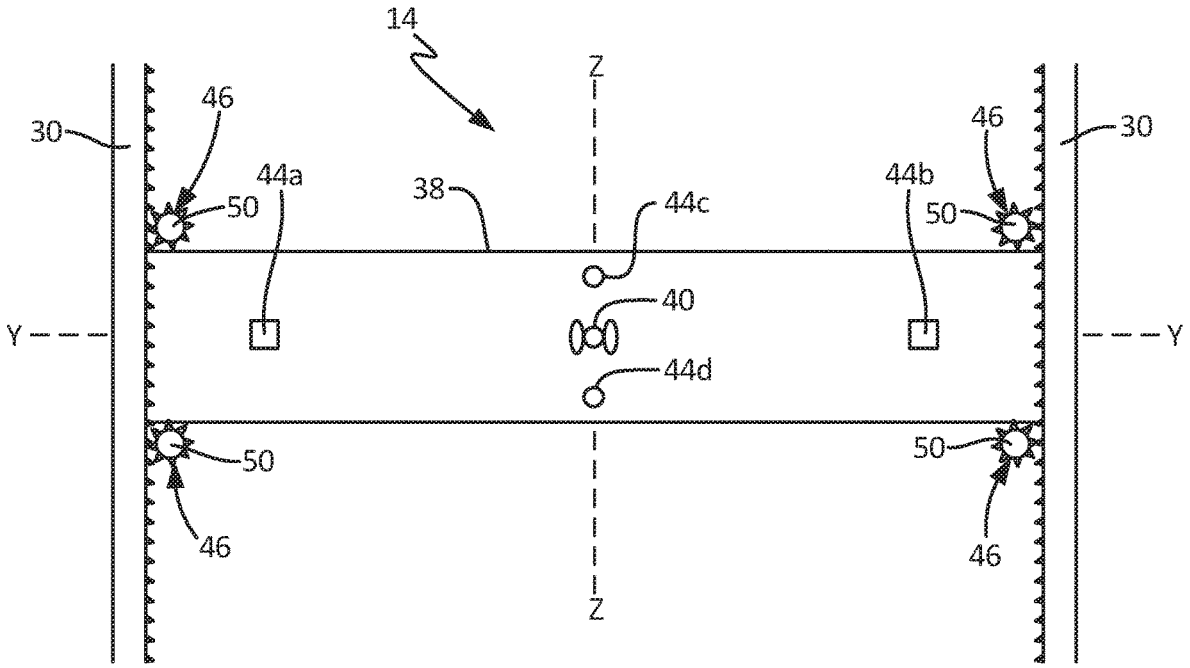
FIG. 1C is a front elevation view of a movable applicator assembly.

FIG. 1A is an isometric view of automated mobile spray system 10. FIG. 1B is a side elevation view of automated mobile sprayer (AMS) 12. FIG. 1C is a front elevation view of applicator assembly 14. FIGS. 1A-1C will be discussed together. Automated mobile spray system 10 includes AMS 12*a* and AMS 12*b* (collectively herein "AMS 12") and fluid supply 16. AMS 12 is a mobile ground vehicle configured to apply a fluid, such as paint, varnish, water, oil, stains, finishes, coatings, and solvents, among others, onto a surface. Examples surfaces can be interior, such as walls, or exterior, such as buildings, among others.

Each AMS 12 includes applicator assembly 14, base 18, and frame 20. Base 18 includes wheels 22 and wheel motors 24 (see FIG. 1B). Frame 20 includes longitudinal supports 26, lateral supports 28, vertical support 30, angled supports 32, boom 34, and wall supports 36. Applicator assembly 14 includes applicator arm 38, nozzle 40, spray tube 42 (see FIG. 1B), applicator sensors 44*a*-44*d* (see FIG. 1C, collectively herein "sensors 44"), and applicator drives 46 (see FIG. 1B). Applicator drives 46 include drive motors 48 and drive gears 50 (see FIG. 1C). Wall supports 36 include support arm 52 and support roller 54 (see FIG. 1B). Fluid supply 16 includes reservoir 56, pump 58, and supply hoses 60*a*-60*b* (collectively herein "supply hose 60"). Each AMS 12 includes longitudinal axis X-X, lateral axis Y-Y, and vertical axis Z-Z that are defined relative to that AMS 12.

Base 18 supports the components of AMS 12. Base 18 can be made of any desired material for housing and/or supporting the various components of AMS 12. For example, base 18 can be made from metal and/or composite. In some examples, base 18 is weighted to prevent tipping of AMS 12 during operation. Wheels 22 are disposed on base 18 and provide motive power to base 18. Wheels 22 are oriented to drive AMS 12 parallel to surface 62 being sprayed. Wheel motors 24 are disposed in base 18 and are operatively connected to wheels 22. As shown, each wheel 22 is associated with an individual wheel motor 24. Each wheel motor 24 individually controls each wheel 22 to drive lateral movement of AMS 12 and to cause turning of AMS 12. In some examples, AMS 12 steers via a skid steer technique, while in other examples AMS 12 steers by wheels 22 reorienting to face various drive directions. Wheel motors 24 can be any suitable motor for driving wheels 22, such as DC electric motors, stepper motors, pneumatic motors, gas-powered motors, brushed electric motors, brushless electric motors, or any other desired motor. Where wheel motors 24 are pneumatic, base 18 can support an air compressor to provide compressed air to drive wheel motors 24. While base 18 is described as including wheels 22, it is understood that base can include any desired form of locomotion. For example, base 18 can include tracks or a combination or wheels and tracks.

Frame 20 is mounted on base 18 and supports applicator assembly 14. Longitudinal supports 26 extend from base 18 and towards surface 62. Vertical supports 30 extend vertically from a distal end of longitudinal supports 26. Longitudinal supports 26 extend off of base 18 towards surface 62 such that vertical supports 30 are disposed closer to surface 62 than base 18. Lateral supports 28 extend between vertical supports 30 to provide structural integrity to frame 20. Angled supports 32 extend from vertical supports 30 and provide structural support to frame 20. In some examples, angled supports 32 extend from vertical supports 30 and are connected to longitudinal supports 26. In other examples, angled supports 32 extend from vertical supports 30 and are connected to base 18. Frame 20 can be made of any suitable material for supporting components of AMS 12, such as metal or a composite material. For example, frame 20 can be made from carbon fiber.

Wall supports 36 extend from vertical supports 30 towards surface 62. Support arm 52 extends from vertical support 30 a desired distance towards surface 62. Support roller 54 is disposed at a distal end of support arm 52 opposite vertical support 30. Support roller 54 is configured to contact surface 62 and smoothly traverse surface 62. Support roller 54 can be of any desired configuration for smoothly traversing surface 62, such as a ball or wheel, among other options. Wall support 36 extends closer to surface 62 than frame 20 or base 18. In some examples, support arm 52 is sized to correspond to a desired spray distance X between nozzle 40 and surface 62. Support arm 52 thus ensures that nozzle 40 maintains the desired spray distance throughout spraying. Wall support 36 is configured to brace frame 20 against surface 62 to prevent other components of AMS 12 from contacting surface 62. For example, AMS 12 can imbalance towards surface 62, and wall support 36 prevents AMS 12 from tipping into surface 62. As discussed above, base 18 can be weighted to further prevent tipping. AMS 12 can include as many or as few wall supports 36 as desired. Wall support 36 can be formed from metal, composite, or any other suitable sturdy material to maintain the desired spacing. In some examples, wall support 36 can include multiple members that are movable relative to each other, such as the configuration of roller assembly 148 (shown in FIG. 5). As such, wall support 36 can provide a cushioning effect between AMS 12 and surface 62.

Applicator assembly 14 is supported by frame 20 and configured to apply a spray fan of fluid onto surface 62. Applicator arm 38 extends between and is supported by vertical supports 30. Applicator arm 38 is supported to allow applicator arm 38 to move vertically along vertical axis Z-Z, while preventing movement relative to frame 20 along either longitudinal axis X-X or lateral axis Y-Y. Applicator arm 38 is supported by base 18. In some examples, applicator arm 38 is mounted to base 18 via frame 20, such that base 18 supports frame 20 and frame supports applicator arm 38. In some examples, applicator arm 38 is directly attached to base 18, but it is understood that applicator arm 38 need not be directly attached to base 18. Frame 20 also prevents any relative rotation of applicator arm 38. In some examples, each vertical support 30 includes a groove into which one or more projections from applicator arm 38 extend, thereby ensuring that applicator arm 38 is properly aligned during spraying and preventing lateral and longitudinal movement of applicator arm 38. For example, applicator arm 38 can include one or more flanges extending from each end, can include one or more pegs extending from each end, or can include any other projection suitable for preventing lateral and longitudinal movement while allowing vertical movement. While applicator assembly 14 is described as supported by frame 20, it is understood that applicator assembly 14 is supported by base 18 by way of being directly mounted on frame 20, which is directly mounted on base 18. As such, applicator assembly 14 is supported by base 18 by way of frame 20.

Applicator drive 46 is supported by applicator arm 38 and is configured to drive vertical movement of applicator arm 38 along vertical axis Z-Z. Drive motors 48 are supported by applicator arm 38, and drive gears 50 engage vertical supports 30. Drive motors 48 drive the rotation of drive gears 50. Drive gears 50 displace applicator arm 38 vertically relative to vertical supports. For example, drive gears 50 can engage vertical supports 30 in a rack and pinion arrangement, where teeth of drive gears 50 engage grooves in vertical supports 30. In other examples, a pulley system can be attached to applicator arm 38 to displace applicator arm 38 relative to vertical supports 30. For example, a rope can be attached to the top of applicator arm 38 and fed over a pulley to a spool, the spool winds or unwinds the rope to drive displacement of applicator arm 38. In one example, drive motors 48 are mounted on applicator arm 38 and wind the rope to drive displacement of applicator arm 38. In another example, drive motors 48 are mounted on frame 20, such as at the tops of vertical supports 30, and are configured to wind the rope. While the pulley example of applicator drive 46 is described as including a rope, it is understood that applicator drive 46 can include a rope, chain, belt, or other flexible member suitable for actuating applicator arm 38 relative to vertical supports 30. Drive motors 48 can be electric motors, such as brushless electric motors, or pneumatic motors.

Spray tube 42 extends longitudinally from applicator arm 38, and nozzle 40 is disposed at an end of spray tube 42 closest to surface 62. Nozzle 40 is configured to generate a spray of fluid for application to surface 62. It is understood that nozzle 40 can eject the spray in any desired configuration, such as a spray fan or a spray cone, among other options. In some examples, nozzle 40 can include a rotatable tip. In other examples, nozzle 40 can be fixed. It is thus understood that nozzle 40 can be of any suitable configuration for spraying the fluid onto surface 62. With longitudinal supports 26 extending off of base 18, nozzle 40 is positioned closer to surface 62 than other components of AMS 12 and is not positioned directly over base 18.

Sensors 44*a* and 44*b* are disposed on applicator arm 38 and are spaced laterally and equidistantly from nozzle 40 on lateral axis Y-Y. Sensors 44*c* and 44*d* are disposed on applicator arm 38 and are spaced vertically and equidistantly from nozzle 40 on vertical axis Z-Z. In some examples, sensors 44 can include one or more of distance sensors, location sensors, inertial sensors, and/or optical sensors. For example, distance sensors can include one or more of a proximity sensor, radar transducer, ultrasonic and/or acoustic rangefinder, laser rangefinder, magnetometer, radar, and lidar, among other options. Location sensors can include a GPS receiver chip. Inertial sensors can include an accelerometer and/or a gyroscope. Optical sensors can include a camera. In an example where sensors 44 include distance sensors, sensors 44 can provide information to AMS 12 regarding a distance of nozzle 40 to surface 62 and an orientation of nozzle 40 relative to surface 62. In examples where sensors 44 include optical sensors, the optical sensor can monitor and assess which areas of surface 62 AMS 12 has applied fluid to, is applying fluid to, and will apply fluid to. Sensors 44 can thus locate particular wall areas and features and can provide relevant locational information to AMS 12. In examples where sensors 44 include inertial sensors, the inertial sensors can provide information regarding the movement and/or acceleration of AMS 12, and particularly of applicator arm 38, regardless of whether the movement and/or acceleration is expected or unexpected.

Fluid supply 16 stores fluid and provides fluid to both AMS 12*a* and AMS 12*b* for application to surface 62. Reservoir 56 is configured to store a bulk volume of fluid. Pump 58 is disposed on reservoir 56 and is configured to draw fluid out of reservoir 56, pressurize the fluid, and drive the fluid downstream to both AMS 12*a* and AMS 12*b*. Reservoir 56 is any suitable vessel for storing a supply of fluid prior to application. For example, reservoir 56 can be a bucket. Pump 58 can be a piston pump, a diaphragm pump, a peristaltic pump, or any other suitable pump for driving the fluid to AMS 12 under pressure. In some examples, pump 58 generates sufficient pressure to cause nozzle 40 to atomize the fluid and generate the spray fan. In other examples, each AMS 12 includes an on-board pump configured to generate the high pressure (about 500-4,000 psi) required to atomize the fluid.

Supply hose 60*a* extends from pump 58 to AMS 12*a* to provide the pressurized fluid to nozzle 40 of AMS 12*a* for application to surface 62. Supply hose 60*b* extends from pump 58 to AMS 12*b* to provide the pressurized fluid to nozzle 40 of AMS 12*b* for application to surface 62. While fluid supply 16 is described as providing fluid to both AMS 12*a* and AMS 12*b*, it is understood that automated mobile spray system 10 can include any desired number of AMS 12 and any desired associated number of fluid supply 16. As such, each fluid supply 16 can be connected to one, two, three, or any other desired number of AMS 12. In some example, each AMS 12 includes a dedicated fluid supply 16, which can be disposed onboard, such as on base 18, or off-board of AMS 12.

Boom 34 extends rearward from frame 20, away from surface 62. Boom 34 supports supply hose 60 as supply hose 60 extends from pump 58 to applicator arm 38. Boom 34 supporting supply hose 60 prevents supply hose 60 from becoming entangled in wheels 22. In some examples, a distal end of boom 34 includes a hook, over which the supply hose 60 is hung. The attachment point between boom 34 and supply hose 60 can extend beyond base 18, providing additional protection against entanglement. Supply hose 60 can be any suitable hose for transferring the fluid from pump 58 to nozzle 40. For example, supply hose 60 can be a wire reinforced hose for withstanding the high pressures required for spraying. Boom 34 can be of any sufficiently sturdy material for supporting supply hose 60, such as metal or composite.

During operation, AMS 12 is configured to spray fluids, such as paint, on surfaces that are difficult for humans to easily access and/or efficiently apply the fluid. In some examples, AMS 12 applies fluid to a surface using a plurality of parallel, raster passes. A raster pass occurs when a first horizontal or vertical stripe is applied to a surface, and the second horizontal or vertical stripe is applied directly adjacent and/or overlapping with the first stipe. Any number of stripes can be applied until the surface is sufficiently coated. For example, AMS 12 can apply a stripe having X width with each pass. AMS 12 can be programmed to provide a 50% overlap with each pass, such that AMS 12 will shift X/2 relative to the first stripe before the next stripe is applied. The amount of overlap can be any desired value as determined by the user or the particular application, from about 0% to about 100%. Nozzle 40 is oriented to generate the horizontal spray fan when AMS 12 is applying a vertical stripe, and nozzle 40 is oriented to generate the vertical spray fan when AMS 12 is applying a horizontal stripe.

Reservoir 56 stores a supply of fluid for application to surface 62. Pump 58 is activated, either autonomously by a controller, such as controller 74 (FIG. 2A), or by the user, and pump 58 draws the fluid from reservoir 56 and drives the fluid downstream to nozzle 40 through supply hose 60. Pump 58 generates sufficient pressure to cause nozzle 40 to atomize the fluid and generate the spray fan. In some examples, a check valve controls the spray generation at nozzle 40, such that the fluid cannot flow to nozzle 40 when check valve is closed and can flow to nozzle 40 when the check valve is open. In other examples, nozzle 40 can be configured to generate the spray fan whenever pump 58 is providing the pressurized fluid. AMS 12 can include a second, onboard pump to provide the high pressure required for spraying. As such, pump 58 can, in some examples, be a low pressure pump for driving the fluid to the onboard pump, which then generates the desired spray pressure.

Nozzle 40 generates the spray and traverses surface 62, laterally and/or vertically, to apply the fluid to surface 62. AMS 12 causes the relative movement of nozzle 40, by shifting applicator arm 38, to move nozzle 40 vertically, or driving wheels 22, to shift nozzle 40 laterally. Sensors 44 are spaced equidistantly relative to nozzle 40 to ensure that nozzle 40 is properly positioned during spraying. Sensors 44 provide locational data regarding the distance of applicator arm 38, and thus nozzle 40, to surface 62. It is understood that the desired position of nozzle 40 can include both a coordinate position, such as a distance to surface 62, and an orientation, such as nozzle 40 being orthogonal to surface 62 or at another angle relative to surface 62. In some examples, a non-orthogonal spray fan provides a satisfactory finish, so long as the spray orientation is maintained throughout each spray pass. The quality of the finish applied to surface 62 depends on several factors, such as the distance that nozzle 40 is spaced from surface 62, the desired spray fan width, the thickness of the coating being applied, the type of fluid, the spray pressure, and the size of the orifice in nozzle 40, among other factors.

The locational data provided by lateral sensors 44 and vertical sensors 44 is used by AMS 12 to ensure that nozzle 40 is maintained at the desired position throughout the spray process. For example, both sensor 44*a* and sensor 44*b* are spaced equidistant from nozzle 40 on axis Y-Y, and both sensor 44*c* and sensor 44*d* are equidistant from nozzle 40 on axis Z-Z. Where sensors 44*a*-44*b* and sensors 44*c*-44*d* all indicate the same distance to surface 62, then AMS 12 knows that nozzle 40 is orthogonal to surface 62 and knows the distance that nozzle 40 is from surface 62. If one of sensors 44*a*-44*b* indicates a different distance than the other of sensors 44*a*-44*b*, then AMS 12 knows that nozzle 40 is obliquely tilted towards the sensor 44*a* or 44*b* that indicates a further distance to surface 62 than the other sensor 44*a* or 44*b*. Similarly, if one of sensors 44*c*-44*d* indicates a different distance than the other of sensors 44*c*-44*d*, then AMS 12 knows that nozzle 40 is obliquely tilted towards the sensor 44*c* or 44*d* that indicates a further distance to surface 62 than the other sensor 44*c* or 44*d*. AMS 12 can take corrective action to reorient to the desired spraying position based on the information provided by sensors 44. For example, AMS 12 can command one or more of wheel motors 24 to cause rotation of wheels 22 to reorient AMS 12 to the desired spray position. For example, where sensor 44*a* indicates a greater distance to surface than sensor 44*b*, AMS 12 can adjust its orientation until sensor 44*a* and sensor 44*b* indicate the same distance, and such that that indicated distance is the desired distance. While AMS 12 is described as taking corrective action when nozzle 40 is not orthogonal to the surface, it is understood that AMS 12 can maintain nozzle 40 in any desired spray orientation. Further, while AMS 12 is described as monitoring the orientation of nozzle 40 based on information from sensors 44*a*-44*d*, it is understood that AMS 12 can monitor the orientation of nozzle 40 based on information from any one or more of sensors 44. For example, a single sensor 44 can provide a distance to surface 62, while two or more sensors 44 can provide an orientation relative to surface 62.

A first example spray event where AMS 12 applies vertical stripes of fluid and a second example spray event where AMS 12 applies horizontal stripes of fluid will be discussed. Nozzle 40 is configured to generate a horizontal spray fan when applying vertical stripes of fluid. The horizontal spray fan has elongate sides that extend laterally relative to surface 62. Nozzle 40 is configured to generate a vertical spray fan when applying horizontal stripes of fluid. The vertical spray fan has elongate sides that extend vertically relative to surface 62. In any instance, nozzle 40 is configured to generate a spray fan that is elongate orthogonal to the direction of travel of nozzle 40.

In the first example spray event, nozzle 40 is oriented to generate the horizontal spray fan. Drive motors 48 activate and cause rotation of drive gears 50. Drives gears 50 cause applicator arm 38 to shift vertically along vertical supports 30. Nozzle 40 generates the spray fan and applies a vertical stripe as applicator arm 38 moves vertically. When nozzle 40 reaches the end of the vertical spray path, such as where sensors 44 indicate that the spray fan has coated surface 62 or when applicator arm 38 reaches the extent of vertical displacement, the spray through nozzle 40 is stopped. For example, the controller can close a valve controlling flow through nozzle 40 or can shut off pump 58, among other options.

AMS 12 shifts laterally relative to surface 62 to apply the second vertical spray path. To shift laterally, AMS 12 activates wheel motors 24, and wheel motors 24 drive the rotation of wheels 22. AMS 12 shifts relative to the first vertical spray path. AMS 12 deactivates wheel motors 24 when sensors 44 indicate that AMS 12 is in the desired position to apply the fluid along the second vertical spray path. In one example, the controller of AMS 12 is preloaded with spray instructions, and the controller causes AMS 12 to shift to the second vertical spray path according to the spray instructions. Sensors 44 provide feedback to the controller to indicate whether AMS 12 is in the desired spray position and whether nozzle 40 is properly oriented relative to surface 62. For example, sensors 44 can indicate the distance that nozzle 40 is located from surface 62 and the orientation of nozzle 40 relative to surface 62. In other examples, the spray instructions provide a set distance that AMS 12 should shift between each stripe. With AMS 12 in the desired spray position for the second vertical spray path, applicator arm 38 is vertically actuated and the spray path through nozzle 40 opens. Nozzle 40 applies the fluid as applicator arm 38 traverses the second vertical spray path. When applicator arm 38 reaches the end of the second vertical spray path, the spray through nozzle 40 is stopped and AMS 12 transitions to apply the fluid in a third vertical spray path. It is understood, that the spray through nozzle 40 can be tied to motion of AMS 12, such that the spray is not generated until nozzle 40 is traversing surface 62 at a steady speed, preventing uneven coatings on surface.

In the second example spray event, nozzle 40 is oriented to generate the vertical spray fan. The controller activates wheel motors 24 to cause AMS 12 to displace laterally along surface 62. Wheels 22 rotate and drive AMS 12 along the length of the first horizontal spray path. Nozzle 40 generates the spray fan and applies the horizontal stripe as AMS 12 moves laterally relative to surface 62. Nozzle 40 continues to apply the spray fan until nozzle 40 reaches the end of the first horizontal spray path. The controller stops the spray through nozzle 40, and AMS 12 stope lateral movement. Applicator assembly 14 transitions nozzle 40 to the second horizontal spray path. For example, the controller can activate drive motors 48 to drive vertical displacement, either up or down, of applicator arm 38. Applicator arm 38 displaces a set distance, which set distance can be based on a preprogrammed spray routine or input by the user, until nozzle 40 is properly positioned on the second horizontal spray path. In one example, sensors 44 provide feedback to the controller to indicate when nozzle 40 is properly positioned to apply the fluid along the second horizontal spray path. With AMS 12 in the desired spray position for the second horizontal spray path, wheel motors 24 are activated and wheels 22 drive AMS 12 along the second horizontal spray path. The spray though nozzle 40 is activated and AMS 12 continues to traverse the second horizontal spray path as nozzle 40 applies the fluid in a horizontal stripe. Nozzle 40 continuously applies the spray as AMS 12 traverses the second horizontal spray path. When AMS 12 reaches the end of the second horizontal spray path, the spray through nozzle 40 is stopped and AMS 12 transitions applicator arm 38 to apply the fluid in a third horizontal spray path. It is understood, that the spray through nozzle 40 can be tied to motion of AMS 12, such that the spray is not generated until nozzle 40 is traversing surface 62 at a steady speed, preventing uneven coatings on surface.

Automated mobile spray system 10 provides significant advantages. Automated mobile spray system 10 can include multiple of AMS 12 to provide quicker, more efficient fluid application to multiple surfaces. A single reservoir 56 and pump 58 can provide fluid to multiple of AMS 12, reducing the number of individual parts fluid supplies. AMS 12 provides significant advantages. AMS 12 provides automated fluid application at locations that are inconvenient for human painters. Nozzle 40 traverses surface 68 both laterally and horizontally to apply the fluid. Applicator arm 38 is restricted to vertical movement, ensuring that nozzle 40 does not displace laterally or longitudinally during operation. Sensors 44 maintain the position of nozzle 40 relative to surface 68 to ensure an even, high-quality spray finish. Wheels 22 can be individually controlled to provide AMS 12 with zero-radius turning and to allow for precise control of AMS 12 movement.

Figure 2A:
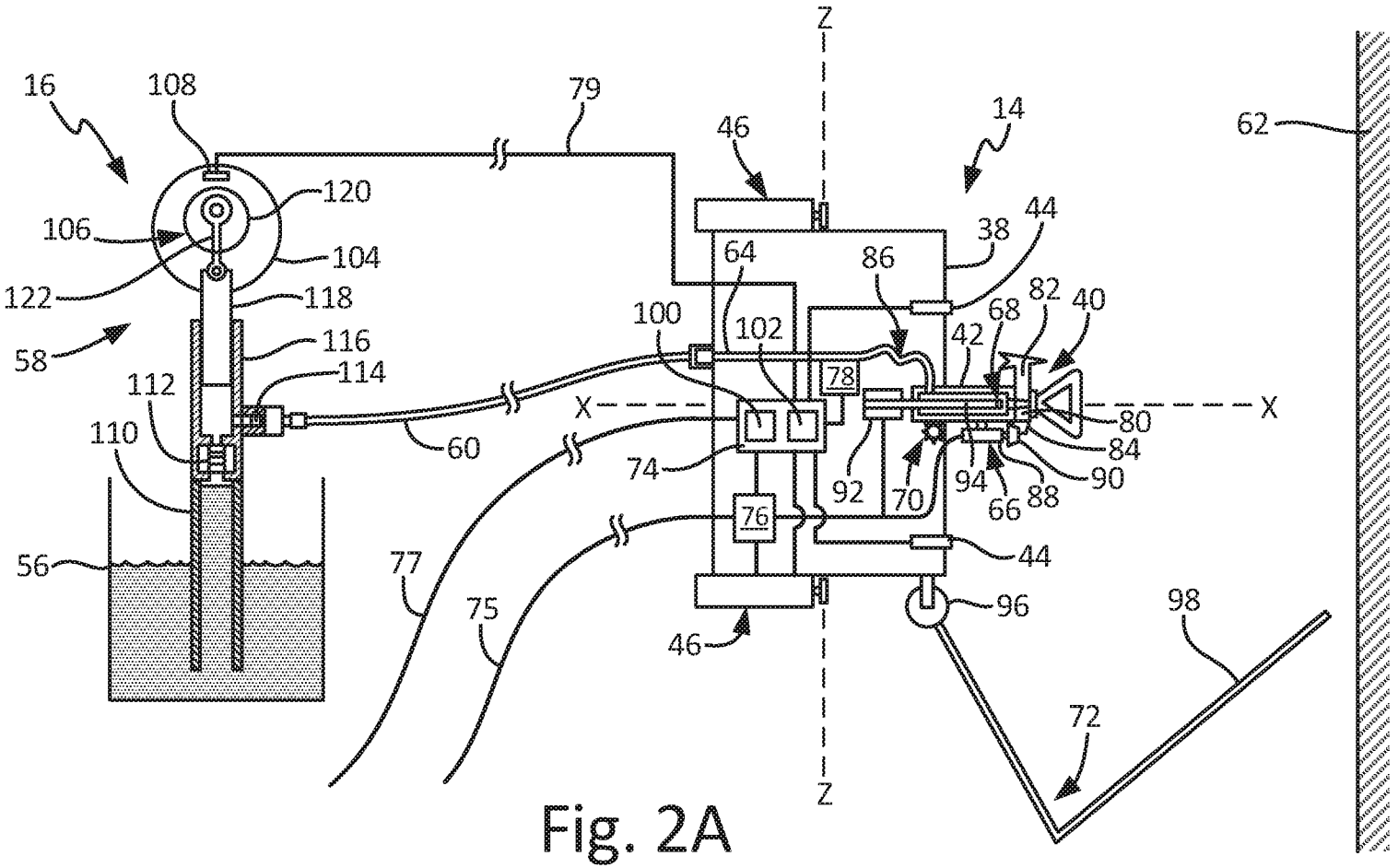
FIG. 2A is a simplified cross-sectional, schematic view of an applicator assembly and a fluid supply assembly.
Figure 2B:
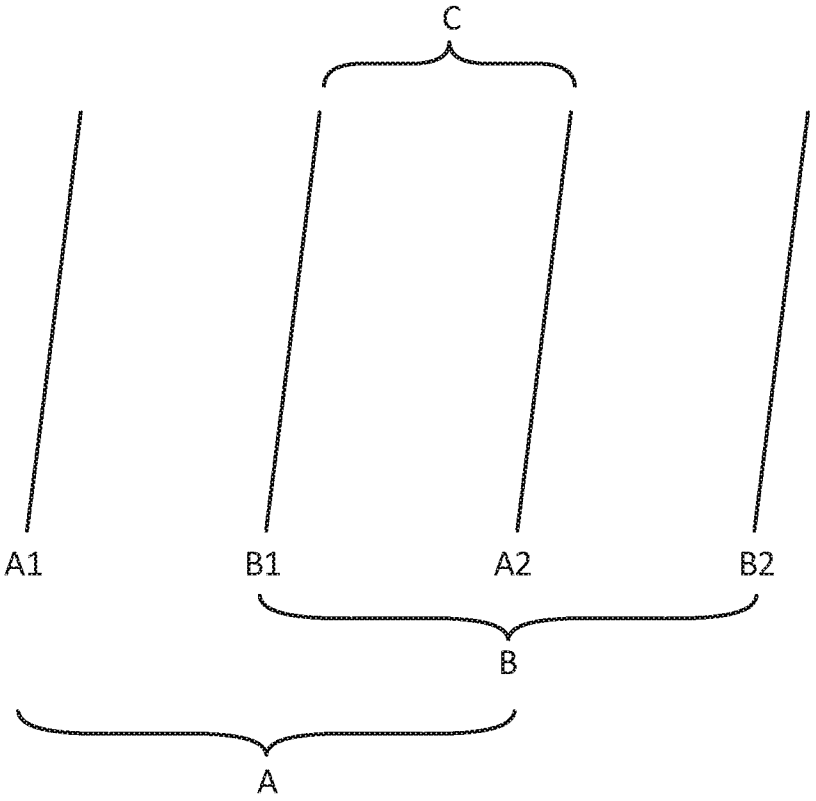
FIG. 2B is a schematic view of vertical fluid stripes.

FIG. 2A is a schematic, cross-sectional view of applicator assembly 14 of AMS 12 and fluid supply 16. FIG. 2B is a schematic showing vertical fluid stripe A and vertical fluid stripe B. FIGS. 2A and 2B will be discussed together. Applicator assembly 14 includes applicator arm 38, nozzle 40, spray tube 42, sensors 44, applicator drives 46, internal supply line 64, de-clog mechanism 66, spray valve 68, linear actuator 70, screen 72, controller 74, power source 76, and fluid sensor 78. Nozzle 40 includes rotatable tip 80. Rotatable tip 80 includes barrel 82 and tip gear 84. Internal supply line 64 includes slack 86. De-clog mechanism 66 includes de-clog motor 88 and de-clog gear 90. Spray valve 68 includes valve actuator 92 and needle 94. Screen 72 includes screen motor 96 and blocker 98. Controller 74 includes memory 100 and processor 102. Fluid supply 16 incudes reservoir 56, pump 58, and supply hose 60. Pump 58 includes pump motor 104, drive 106, speed sensor 108, inlet tube 110, inlet check valve 112, outlet check valve 114, cylinder 116, and piston 118. Drive 106 includes eccentric 120 and connecting rod 122. It is understood that the connections shown between various onboard components and between various off-board components can represent any one or more of electrical connections, communications connections, physical connections, and wired and/or wireless connections.

Fluid supply 16 provides fluid to applicator assembly 14, and applicator assembly 14 generates a spray of fluid through nozzle 40 for application on surface 62. Reservoir 56 holds a supply of fluid for application. Pump 58 is disposed on reservoir 56 and configured to draw the fluid from reservoir 56, pressurize the fluid, and drive the fluid downstream to applicator assembly 14. Inlet tube 110 extends into reservoir 56 from cylinder 116. Inlet check valve 112 is disposed in the fluid path between inlet tube 110 and cylinder 116. Inlet check valve 112 is a one-way check valve configured to allow fluid to flow into cylinder 116 from inlet tube 110 but to prevent fluid from flowing back into reservoir 56 from cylinder 116. Outlet check valve 114 is a one-way check valve disposed in the fluid path between cylinder 116 and supply hose 60. Outlet check valve 114 is configured to allow fluid to flow downstream out of cylinder 116 but to prevent fluid from flowing upstream from supply hose 60 back into cylinder 116. Both inlet check valve 112 and outlet check valve 114 can be any suitable one-way valve, such as a ball check valve, a needle valve, or any other desired type of one-way valve.

Pump motor 104 provides rotational motion to drive 106, and drive 106 converts the rotational motion of pump motor 104 into linear, reciprocating motion of piston 118. Pump motor 104 can be any suitable motor for providing a rotational input to pump 58, such as a high or low voltage electric brushed motor, among other options. Piston 118 is disposed within cylinder 116 and is configured to reciprocate within cylinder 116 to pump the fluid. Drive 106 extends between and connects pump motor 104 and piston 118. Eccentric 120 is connected to pump motor 104 and is rotatably driven by pump motor 104. Connecting rod 122 extends from eccentric 120 and is attached to piston 118. Connecting rod 122 drives piston 118 in a linear, reciprocating motion. While pump 58 is described as a single acting piston pump, it is understood that alternative pumping mechanisms can be used to pressurize the fluid and drive the pressurized fluid to applicator assembly 14. For example, pump 58 can include multiple pistons, can be a double acting pump, can be a diaphragm pump, can be a peristaltic pump, or can be of any other suitable configuration for pressurizing and driving the fluid. Pump 58 is configured to generate the spray pressure necessary to atomize the fluid into a spray fan (about 500-4000 psi).

Speed sensor 108 is disposed on pump motor 104 and is configured to sense the speed of pump motor 104. As shown, the speed of pump motor 104 is directly correlated to the reciprocation rate of piston 118. As such, speed sensor 108 sensing the speed of pump motor 104 also provides the reciprocation rate of piston 118 and other associated parameters. Speed sensor 108 communicates with controller 74 via communication link 79. Speed sensor 108 can be disposed in a motor housing or at any other suitable location. Speed sensor 108 can be any suitable sensor for detecting the speed of pump motor 104, such as a Hall effect sensor, a proximity sensor, or any other suitable sensor. In some examples, speed sensor 108 measures the speed of pump motor 104 based on an element, such as a magnet or some other element, disposed on eccentric 120 or connecting rod 122 coming close to and then moving away from speed sensor 108. The speed of pump motor 104 has a direct effect on various other spray parameters, such as flow rate and fluid pressure.

Applicator arm 38 is disposed between vertical supports 30 (shown in FIGS. 1A-1B) and movement of applicator arm 38 is restricted such that applicator arm 38 can move vertically, but not laterally or longitudinally. Applicator drives 46 are configured to drive applicator arm 38 vertically relative to vertical supports 30. Drive motors 48 are disposed on applicator arm 38, and drive gears 50 engage the vertical supports to cause vertical movement of applicator arm 38. Sensors 44 extend through applicator arm 38 and are configured to provide information regarding the location, orientation, movement, and positioning. In some examples, sensors 44 can include distance sensors, optical sensors, and/or inertia sensors. Screen motor 96 is mounted on applicator arm 38. Blocker 98 extends from screen motor 96, and is movable between a spraying position (shown in FIG. 2A) and a blocking position where blocker 98 is disposed between nozzle 40 and surface 62.

Internal supply line 64 extends through applicator arm 38 and is connected to supply hose 60. Internal supply line 64 is connected to supply hose 60, to receive fluid from fluid supply 16, and provides a flowpath through applicator arm 38 for the fluid to flow to spray tube 42 and nozzle 40.

Internal supply line 64 includes slack 86, which allows internal supply line 64 to extend and retract with spray tube 42. Slack 86 thus allows spray tube 42 to shift and rotate relative to applicator arm 38. Slack 86 can be formed by a metal tube and/or a flexible wire reinforced tube. Fluid sensor 78 interfaces with internal supply line 64 and is configured to sense a parameter of the fluid flowing within internal supply line 64. For example, fluid sensor 78 can be a digital or analog sensor configured to sense pressure and/or flow within internal supply line 64. It is understood, however, that fluid sensor 78 can be any suitable sensor for measuring a parameter of the fluid within internal supply line 64, such as a force collector-type transducer (e.g., a piezoelectric/piezoresistive strain gauge or a capacitive/electromagnetic transducer), a microelectromechanical (MEMS) sensor, or any other suitable sensor.

Spray tube 42 is supported by applicator arm 38. Nozzle 40 is mounted on a distal end of spray tube 42. Spray valve 68 is disposed within spray tube 42 and is configured to control the flow of fluid out of nozzle 40. Needle 94 extends out of spray tube 42 to valve actuator 92, and valve actuator 92 is mounted in applicator arm 38. Valve actuator 92 controls the movement of needle 94 between an open position where needle 94 is retracted and a closed position where needle 94 is extended and engages a seat. Linear actuator 70 interfaces with spray tube 42 and is configured to move spray tube 42 longitudinally along the X-X axis. Valve actuator 92 can be any suitable device for actuating needle 94, such as a solenoid. In some examples, a spring is disposed in spray valve 68 and actuates needle 94 to the closed position, such that spray valve 68 is normally closed. In such an example, spray valve 68 is open only when valve actuator 92 maintains needle 94 in the open position.

Rotatable tip 80 extends into a tip bore through nozzle 40 and can be rotated between a spraying position and an opposite, de-clog position. Barrel 82 is elongate and is disposed in the tip bore 130. Tip gear 84 is disposed at the distal end of barrel 82 and can project outside of nozzle 40. De-clog mechanism 66 is mounted on spray tube 42 and interfaces with rotatable tip 80. De-clog motor 88 is mounted on spray tube 42, and de-clog gear 90 extends from de-clog motor 88 and interfaces with tip gear 84.

Power source 76 is configured to provide power to components of AMS 12. In some examples, power source 76 provides power to pump 58. Power source 76 can be mounted on AMS 12 or can provide power sourced from an off-board location. In some examples, power source 76 is a battery, such as a rechargeable lithium ion battery. In other examples, power source 76 is provided from an off-board location, such as by electrical cord 75, which can extend to an electrical outlet or a generator.

Controller 74 communicates with sensors 44, applicator drives 46, de-clog mechanism 66, linear actuator 70, fluid sensor 78, valve actuator 92, and pump 58. Controller 74 can also communicate with other components of AMS 12. For example, controller 74 can communicate with wheel motors 24 (shown in FIG. 1B) via communication link to control locomotion of AMS 12. Controller 74 is illustrated as disposed within applicator arm 38, but it is understood that various controllers can be located within base 18 (FIGS. 1A-1B) or at other locations. Controller 74 is configured to perform any of the functions discussed herein, including receiving an output from any sensor referenced herein, detecting any condition or event referenced herein, and controlling operation of any components referenced herein. It is understood that controller 74 can include hardware, firmware, and/or stored software, and controller 74 can be entirely or partially mounted on one or more boards. While controller 74 is illustrated as a single unit, it is understood that controller 74 can be disposed across one or more boards and can be and/or include control circuitry.

Controller 74 is configured to both store software and to implement functionality and/or process instructions. Controller 74 can communicate via wired and/or wireless communications, such as serial communications (e.g., RS-232, RS-485, or other serial communications), digital communications (e.g., Ethernet), WiFi communications, cellular communications, or other wired and/or wireless communications. Memory 100 configured to store software that, when executed by processor 102, causes AMS 12 and fluid supply 16 to execute instructions and apply the fluid to a surface. For example, processor 102 can be a microprocessor, a controller, a digital signal processor (DSP), an application specific integrated circuit (ASIC), a field-programmable gate array (FPGA), or other equivalent discrete or integrated logic circuitry. Controller 74 can be configured to store information during operation. Memory 100, in some examples, is described as computer-readable storage media. In some examples, a computer-readable storage medium can include a non-transitory medium. The term "non-transitory" can indicate that the storage medium is not embodied in a carrier wave or a propagated signal. In some examples, memory 100 is a temporary memory, meaning that a primary purpose of memory 100 is not long-term storage. Memory 100, in some examples, is described as volatile memory, meaning that memory 100 does not maintain stored contents when power to controller 74 is turned off. Memory 100, in some examples, also includes one or more computer-readable storage media. Memory 100 can be configured to store larger amounts of information than volatile memory. Memory 100 can further be configured for long-term storage of information. In some examples, memory 100 includes non-volatile storage elements.

During operation, a spray routine can be initiated by controller 74 and/or by a user. When a spray routine is implemented, controller 74 positions AMS 12, and thus applicator assembly 14 and nozzle 40, at the desired start location. Controller 74 controls movement of AMS 12 via communication link 77.

AMS 12 moves to position nozzle 40 at a desired distance from surface 62 for spraying. With nozzle 40 at approximately the desired distance from surface 62, controller 74 provides fine adjustments to the distance between nozzle 40 and surface 62 with linear actuator 70. Linear actuator 70 engages spray tube 42, such as in a rack and pinion configuration, and causes spray tube 42 to extend and retract relative to applicator arm 38. As such, linear actuator 70 adjusts the distance between nozzle 40 and surface 62. Slack 86 in internal supply line 64 maintains the connection between internal supply line 64 and spray tube 42 as spray tube 42 extends and retracts. Linear actuator 70 can be configured to extend or retract spray tube 42 in a single dimension along longitudinal axis X-X (e.g., moving the nozzle 40 closer to the wall when extending, and moving the nozzle 40 further away from the wall when retracting), which is independent from horizontal or vertical movement of nozzle 40 relative to surface 62. During operation, controller 74 can control the position of spray tube 42 to counteract any unexpected distance variations, due to AMS 12 rocking, for example.

Controller 74 confirms that nozzle 40 is in the desired spray position and initiates spraying. Controller 74 can confirm the position of nozzle 40 based on information from sensors 44, the distance displaced by linear actuator 70, or any other suitable source of information. Pump motor 104 drives the rotation of eccentric 120, and connecting rod 122 drives piston 118 in a linear, reciprocating manner. During a suction stroke, connecting rod 122 pulls piston 118 upwards through cylinder 116. The upward movement of piston 118 creates a vacuum condition in cylinder 116, which causes inlet check valve 112 to shift to the open position and draws fluid into cylinder 116 through inlet tube 110. After piston 118 completes the suction stroke, connecting rod 122 pushes piston 118 through cylinder 116. Piston 118 pressurizes the fluid in cylinder 116, causing inlet check valve 112 to close and outlet check valve 114 to shift to the open position. With outlet check valve 114 open, the pressure in cylinder 116 drives the fluid downstream through outlet check valve 114 and into supply hose 60. The fluid flows downstream through supply hose 60, to internal supply line 64, and to spray tube 42 and nozzle 40.

Controller 74 provides a start spray command to valve actuator 92 to initiate spraying. The start spray command causes valve actuator 92 to retract needle 94, thereby opening a flow path through spray valve 68. In some examples, valve actuator 92 is a solenoid, and controller 74 causes power source 76 to electrically activate valve actuator 92 to shift the position of needle 94. The fluid flows through the flow path in spray valve 68 and is ejected as an atomized spray by nozzle 40. It is understood that nozzle 40 can be configured to generate the atomized spray in any desired configuration. For example, nozzle 40 can generate a spray fan, a spray cone, or any other desired spray configuration. To cease spraying, controller 74 can deactivate pump motor 104 or cause needle 94 to shift to the closed position, among other options. In some examples, controller 74 can cause valve actuator to shift needle 94 to the closed position. In other examples, a spring can cause needle 94 to return to the closed position when electricity is removed from valve actuator 92.

Controller 74 controls spraying to apply a smooth and even finish on surface. To avoid areas of uneven thickness, controller 74 controls spraying such that nozzle 40 is in motion relative to surface 62 before any fluid is sprayed from nozzle 40. Ensuring that nozzle 40 is in motion when spraying begins also eliminates the unwanted effect caused by spitting, which most commonly occurs as spraying starts and as spraying ends. With nozzle 40 already in motion, any unwanted spray pattern is evenly distributed on surface 62 and can be corrected with subsequent fluid application. To ensure that nozzle 40 is already in motion before spraying is activated, controller 74 can implement a delay between activating wheels 22 or applicator drives 46 and opening spray valve 68.

In examples where a horizontal stripe is desired, controller 74 sends a command to wheel motors 24 to cause wheel motors 24 to drive wheels 22 and initiate lateral movement, thereby causing nozzle 40 to traverse horizontally relative to surface 62. Based on information from sensors 44, such as inertial sensors, controller 74 determines that nozzle 40 is moving at a constant speed. In some examples, controller 74 can determine if the location of nozzle 40 is within a desired spray area. For example, the spray plan can include boundaries defining areas to be sprayed, and controller 74 determines the location of nozzle 40 relative to the boundary defining the area to be sprayed before initiating spraying. For example, sensors 44 can indicate the relative location of nozzle 40 to a spray boundary. Controller 74 causes valve actuator 92 to shift needle 94 to the open position based on nozzle 40 being at the constant speed and crossing the boundary of the surface area intended to be sprayed. The full length of the stripe is sprayed with continuous motion of nozzle 40. Controller 74 ceases spraying when nozzle 40 reaches the end of the surface area intended to be sprayed, and before nozzle 40 stops moving relative to surface 62. To cease spraying, controller 74 deactivates pump motor 104 and/or causes closes spray valve 68. After the spray through nozzle 40 is stopped, controller 74 stops relative movement of nozzle 40 by sending a stop command to wheel motors 24 to stop movement after spraying through nozzle 40 has stopped. Controller 74 then shifts nozzle 40 a set distance relative to surface 62 and positions nozzle 40 to apply another stripe. For example, controller 74 activates drive motors 48 to cause applicator arm 38 to shift a set vertical distance. With applicator arm 38 in the desired position for the second stripe, controller 74 deactivates drive motors 48 and initiates application of another horizontal stripe.

In examples where a vertical stripe is desired, controller 74 sends a command to drive motors 48 to cause drive motors 48 to rotate drive gears 50 and initiate vertical movement of applicator arm 38, causing nozzle 40 to displace vertically relative to surface 62. Based on information from sensors 44, such as inertial sensors, controller 74 determines that nozzle 40 is moving at a constant speed. Based on nozzle 40 being at the constant speed and crossing the boundary of the surface area intended to be sprayed, controller 74 causes valve actuator 92 to shift needle 94 to the open position, thereby opening a flowpath through spray valve 68. The full length of the stripe is sprayed using continuous motion of nozzle 40. Controller 74 ceases spraying when nozzle 40 reaches the end of the surface area intended to be sprayed, and before nozzle 40 stops moving relative to surface 62, such as by closing spray valve 68 and/or deactivating pump motor 104. After the spray through nozzle 40 is stopped, controller 74 stops relative movement of nozzle 40 by sending a stop command to drive motors 48 to stop movement of applicator arm 38. Controller 74 shifts nozzle 40 a set distance relative to surface 62 and positions nozzle 40 to apply another stripe. For example, controller 74 activates wheel motors 24 to cause AMS 12 to shift laterally relative to surface 62. With applicator arm 38 in the desired position for the second stripe, controller 74 deactivates wheel motors 24. Controller 74 then activates drive motors 48 and initiates application of another stripe in the same manner.

During spraying of both horizontal and vertical stirpes, controller 74 can control spraying based on raster stripes. FIG. 2B shows an example where AMS 12 applies vertical fluid stripe A, bounded by vertical lines A1 and A2, and vertical fluid stripe B, bounded by vertical lines B1 and B2. For example, vertical fluid stripes A and B can be applied using vertical raster stripes. Lines A1 and A2 represent the lateral boundaries of a first spray fan applying a stripe to surface 62, and lines B1 and B2 represent the lateral boundaries of a second spray fan applying a stripe to surface 62. As shown, the first spray fan and the second spray fan are adjacent and overlapping. Vertical stripe A and vertical stripe B overlap by overlap distance C. An overlap parameter can be preset in controller 74 and/or provided by the user to control the amount of overlap between adjacent stripes. The overlap distance C can be a programmable distance or a percentage of overlap between stripes. For example, with a 50% overlap each portion of surface 62 is coated twice.

Prior to initiating spraying, controller 74 can ascertain an actual fan width based on a test strip or during application of the first stripe of the spray routine. Sensors 44, such as optical sensors, provide images of the spray fan to controller 74, and controller 74 can observe the spray fan and identify the edges of the stripe that is being applied to surface 62. For example, controller 74 can identify the edges of the test stripe based on a contrast between the coated and uncoated portions of surface 62. Sensors 44, such as distance sensors, provide information regarding the distance to surface 62. Controller 74 calculates the actual fan width based on the images and distance provided by sensors 44. In some examples, controller 74 utilizes the actual fan width to calculate the overlap distance C to ensure that the desired amount of overlap is achieved. For example, where the desired overlap is 50% and controller 74 calculates the actual fan width is twelve inches, then controller 74 will shift nozzle 40 six inches, vertically or horizontally, relative to the first stripe to position nozzle 40 for the second stripe. If the actual fan width changes during spraying, controller 74 alters the reposition distance for the next raster line to maintain the desired overlap. In some examples, controller 74 can compare an initial actual fan width, which is determined at the beginning of a spray pass, with a final actual fan width, which is determined at the end of the spray pass. Controller 74 can alter the reposition distance based on the difference between the initial actual fan width and the final actual fan width. For example, where the desired overlap is 50% and controller 74 determines that the actual fan width decreased one inch from the previous stripe or during that spray pass, controller 74 cause nozzle 40 to shift by half an inch less than previous stripes. As such, the desired overlap is maintained. In another example where the desired overlap is 50%, controller 74 determines that the actual fan width increased two inches from the previous stripe or during application of that stripe, controller 74 then causes nozzle 40 to shift by one inch more than the previous stripes. As such, the desired overlap is maintained.

Controller 74 also utilizes the actual fan width to provide course adjustments throughout spraying to maintain the actual fan width at a desired fan width. The desired fan width is preset or can be provided by a user. For example, the user can input the desired fan width to controller 74 via a user interface (not shown), such as a keyboard, touch screen, wireless module communicable with a smart phone, a tablet, a laptop, or any other suitable interface device. The actual fan width is dependent on several spray parameters, such as the type of fluid, the size of the orifice through nozzle 40, the flow rate through internal supply line 64, the fluid pressure within internal supply line 64, the speed of pump 58, the movement speed of nozzle 40 relative to surface 62, the distance from nozzle 40 to surface 62, and the desired overlap distance, among others. While the type of fluid, and thus the viscosity and weight of the fluid, is known and set, controller 74 is configured to dynamically control the actual fan width by adjusting the other spray parameters.

Controller 74 compares the actual fan width to the desired fan width and adjusts the spray parameters to cause the actual fan width to match the desired fan width. For example, controller 74 can increase the speed of pump motor 104, thereby increasing the fluid pressure at nozzle 40, to increase the actual fan width. Controller 74 can similarly decrease the speed of pump motor 104, thereby decreasing the fluid pressure at nozzle 40, to decrease the actual fan width. As discussed above, controller 74 can also provide fine adjustments to the distance between surface 62 and nozzle 40 via linear actuator 70.

In some examples, the desired fan width can be the initial actual fan width, such that controller 74 maintains the same separation distance as initially utilized. For example, sensors 44 can indicate changes in the separation distance between nozzle 40 and surface 62 as AMS 12 traverses surface 62, and controller 74 can dynamically adjust the spray parameters based on the sensed change in separation distance. Controller 74 monitors the separation distance in real time to detect increases and decreases in the separation distance. Controller 74 then increases the fan width based on an increased separation distance and/or decreases the fan width based on a decreased separation distance. In an example where controller 74 detects an undesired decrease in the fan width, controller 74 increases the speed of pump motor 104, thereby increasing the fluid pressure at nozzle 40 and increasing the actual fan width. In an example where controller 74 detects an undesired increase in the fan width, controller 74 decreases the speed of pump motor 104, thereby decreasing the fluid pressure at nozzle 40 and decreasing the actual fan width. As discussed above, controller 74 can also provide fine adjustments to the distance between surface 62 and nozzle 40 via linear actuator 70.

Controller 74 is further configured to dynamically adjust any one or more of the spray parameters to maintain the same deposition rate of the fluid on surface 62. For example, controller 74 can control the sweep speed of nozzle 40 based on intentional or unintentional variations in the other spray parameters. If controller 74 recognizes an increase in the fluid flow rate, the fluid pressure, and/or pump motor 104 speed, controller 74 correspondingly increases the sweep speed of nozzle 40. If controller 74 recognizes a decrease in the fluid flow rate, the fluid pressure, and/or pump motor 104 speed, controller 74 correspondingly decreases the sweep speed of nozzle 40. As such, controller 74 maintains the same rate of fluid deposition on surface 62 by dynamically adjusting the sweep speed. Controller 74 can increase or decrease the speed of wheels 22 to adjust the sweep speed when applying a horizontal stripe, and controller 74 can increase or decrease the speed of drive gears 50 to control the movement rate of applicator arm 38 and thereby adjust the sweep speed when applying a vertical stripe. While controller 74 is described as adjusting the sweep speed to control the deposition rate, it is understood that controller 74 can dynamically adjust any one or more of the spray parameters to maintain the desired deposition rate. In some examples, controller 74 can increase or decrease the speed of pump motor 104, thereby increasing or decreasing, respectively, the fluid flow rate and the fluid pressure to control the deposition rate. In some examples, controller 74 can adjust the distance between nozzle 40 and surface 62, such as via linear actuator 70 to control the deposition rate. It is thus understood that controller 74 can maintain any desired spray parameter constant and can adjust other spray parameters to control the quality of the spray. For example, controller 74 can maintain the sweep speed and can dynamically adjust the speed of pump motor 104.

In some examples, controller 74 sets the sweep speed at a speed set point based on the measured level of any one or more of the spray parameters prior to initiating the spray pass. Controller 74 then maintains the sweep speed at the speed set point throughout the spray pass. For example, prior to initiating the spray pass the fluid flow rate, the fluid pressure, and/or pump motor 104 speed are measured. Controller 74 calculates the speed set point based on the measurements, and controller 74 initiates the spray pass and maintains the sweep speed at the speed set point through the full spray pass. In some examples, after the spray pass is complete the spray parameters are re-measured and controller 74 recalculates a new speed set point for the next spray pass. In other examples, controller 74 utilizes the same desired sweep speed for each subsequent spray pass.

Controller 74 ensures that AMS 12 generates an even, high-quality spray. Controller 74 deactivates spraying based on various conditions and events. In one example, controller 74 deactivates spraying when AMS 12 experiences unexpected movement. For example, sensors 44 can include an inertial sensor, such as an accelerometer and/or a gyroscope, and the inertial sensor can provide movement-related information to controller 74. The inertial sensor detects movement of applicator arm 38, and thus of nozzle 40. In some examples, the inertial sensor can be mounted on nozzle 40. The movement detected by the inertial sensor can be expected movement or unexpected movement. Unexpected movement can result from a variety of causes, such as AMS 12 bumping into an object, among other examples. Expected movement results from applicator arm 38 moving relative to surface 62, either horizontally or vertically, during spraying. The inertial sensors sense the movement and provide a sensed acceleration to controller 74. While the information provided to controller 74 is described as a sensed acceleration, it is understood that the sensed acceleration can include negative or positive acceleration and/or a steady speed without an acceleration component.

Controller 74 compares the sensed acceleration to an expected acceleration. In some examples, controller 74 can compare the sensed acceleration to a threshold acceleration. The expected acceleration can be prestored in controller 74 according to the spray plan, can be based on a user input, and/or can be calculated by controller 74 based on other sensor data and inputs, among other options. When the sensed acceleration does not match the expected acceleration, controller 74 deactivates spraying based on that unexpected movement. For example, the inertial sensors detect the acceleration, or other inertial information, and communicate the sensed acceleration to controller 74. Controller 74 compares the sensed acceleration to the expected acceleration, such as from an acceleration profile expected for the particular user command or spray routine, to determine if the movement was expected. If controller 74 determines that the movement is expected, such that the sensed acceleration matches the expected acceleration or is below the threshold acceleration, controller 74 takes no corrective action and AMS 12 continues spraying. If controller 74 determines that the movement is unexpected, such that the sensed acceleration does not match the expected acceleration or exceeds the threshold acceleration, controller 74 immediately stops spraying through nozzle 40, such as by closing spray valve 68 and/or deactivating pump motor 104, and corrects the course of AMS 12. For example, where controller 74 senses that AMS 12 is experiencing an unexpected acceleration, controller 74 immediately causes linear actuator 70 to shift needle 94 to the closed position, thereby closing the flow path through spray valve 68.

In some examples, controller 74 overrides any spray commands, from either the user or an automated spray program, based on the unexpected acceleration. Controller 74 thus stops spraying based on the unexpected acceleration regardless of the input command at that time. Controller 74 allows spraying to resume after the user reenters a spray command and/or controller 74 determines that AMS 12 is in an intended spray position. For example, controller 74 can cause AMS 12 to reposition nozzle 40, such as via wheels 22 for lateral movement or applicator drives 46 for vertical movement, so nozzle 40 is in an intended spray position before spraying resumes. Sensors 44 can provide feedback to controller 74 regarding the position of nozzle 40, and controller 74 can confirm the position of nozzle 40. For example, sensors 44 can include cameras to provide optical feedback, can include location sensors, such as a GPS receiver chip, or can include any other sensor for providing information regarding the position of nozzle 40. Controller 74 allows spraying to resume when nozzle 40 is confirmed to be in the desired spray position. For example, sensors 44 can confirm that nozzle 40 is realigned on the same raster line where spraying previously stopped. Spraying can resume when nozzle 40 is in motion along that raster line.

Controller 74 is further configured to automatically detect and remove a clog during spraying. For example, a sensor, such as fluid sensor 78, speed sensor 108, and/or sensors 44, monitor spray parameters indicative of a tip clog in the orifice of nozzle 40, and controller 74 implements an unclog routine in response to a clog status indicating the presence of a clog. The clog can be detected in any desired manner. For example, fluid sensor 78 can detect a rise in fluid pressure downstream of pump 58 while spraying. The rise in fluid pressure is indicative of fluid not being released through nozzle 40. In another example, an increased load on pump 58 and/or pump motor 104 can be detected and is indicative of a clog. For example, speed sensor 108 can detect a decrease in the speed of pump motor 104, which is indicative of an increased load on pump motor 104. The increased load can also be detected by a strain gauge located on connecting rod 122. In other examples, where sensors 44 include an optical sensors, the optical sensor can detect a diminished or otherwise altered spray fan, which is indicative of a clog. Controller 74 can generate an alarm when the clog is detected to inform the user of the issue. For example, controller 74 can generate an audio alarm, where AMS 12 includes speakers (not shown); a visual alarm, such as lights; and/or an electronic message, such as a communication provided to the user via the user interface.

Figure 3B:
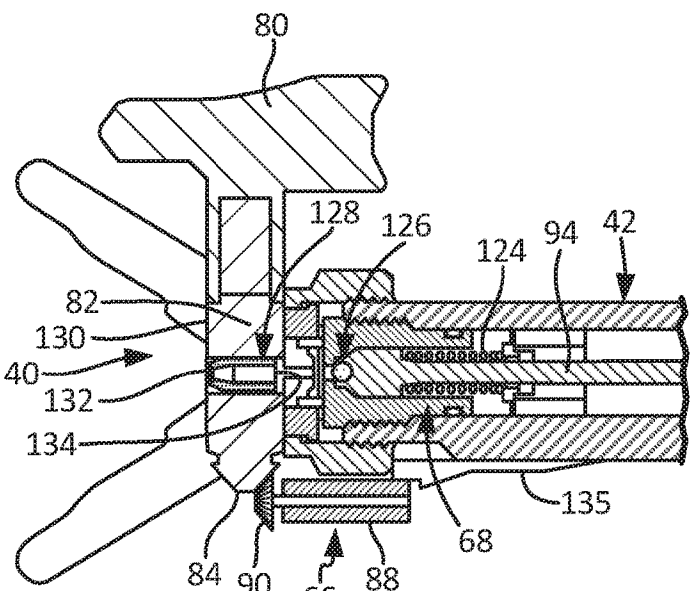
FIG. 3B is a cross-sectional view of the spray tube of FIG. 3A taken along line 3-3 in FIG. 3A.
Figure 3A:
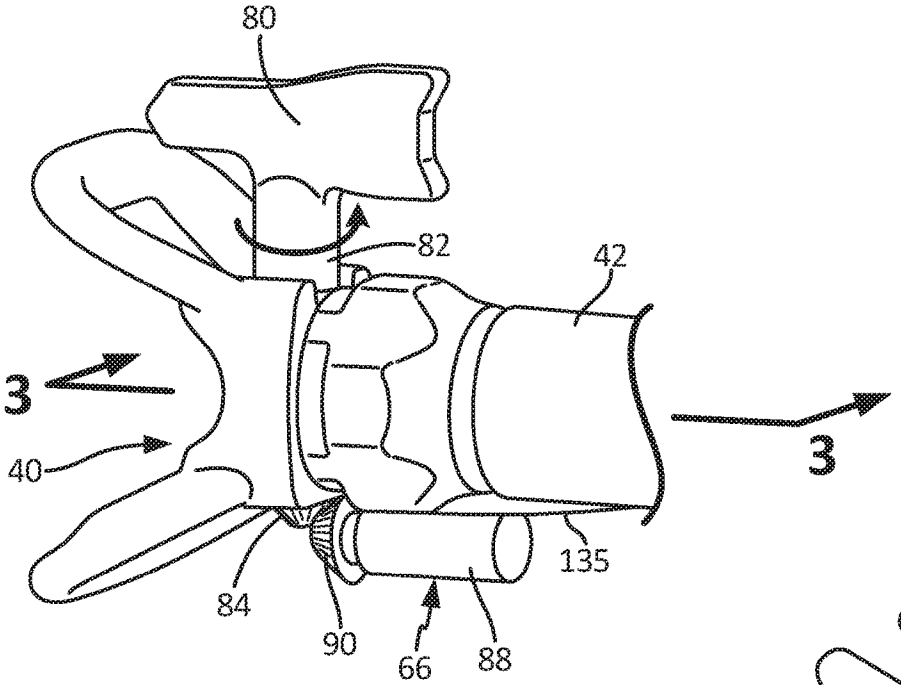
FIG. 3A is an isometric view of a spray tube.

In response to a clog being detected, controller 74 automatically initiates the unclog procedure, discussed in more detail in FIGS. 3A-3B. Controller 74 stops spraying by closing spray valve 68 and/or deactivating sprayer pump motor 104. Controller 74 activates de-clog mechanism 66. De-clog motor 88 rotates rotatable tip 80, through the engagement of de-clog gear 90 and tip gear 84, to the de-clog orientation. Controller 74 activates screen motor 96, and screen motor 96 shifts blocker 98 to the blocking position, where blocker 98 is disposed between nozzle 40 and surface 62 such that any fluid ejected from nozzle 40 is deposited on blocker 98 and not on surface 62. With blocker 98 properly positioned, controller 74 activates pump motor 104 and opens the spray valve 68 to resume spraying and drive the pressurized fluid through nozzle 40. The pressurized fluid ejects the clog from nozzle 40. Controller 74 can confirm that the clog has been removed by detecting a drop in fluid pressure, a decrease in the strain on connecting rod 122, an increase in the speed of pump motor 104, and/or visually via the optical sensor, among other options. With the clog ejected, controller 74 ceases spraying by deactivating pump motor 104 and/or closing spray valve 68. Controller 74 activates de-clog mechanism to shift rotatable tip 80 back to the spraying orientation (shown in FIG. 3B). Controller 74 activates screen motor 96, and screen motor 96 shifts blocker 98 back to the spraying position, such that there is no impediment between nozzle 40 and surface 62. Controller 74 issues the spray command, spray valve 68 shifts to the open position, pump motor 104 is activated, and AMS 12 continues spraying.

While controller 74 is described as utilizing screen 72 during the unclog procedure, it is understood that controller 74 can prevent the clog from depositing on surface 62 in any desired manner. For example, screen 72 can include a cup that is positioned in front of nozzle 40. In another example, controller 74 records the location of nozzle 40 relative to surface 62 when the clog is detected. Controller 74 causes AMS 12 to shift positions such that nozzle 40 is pointed away from surface 62. With nozzle 40 pointed away from surface 62, controller 74 can activate de-clog mechanism 66 to rotate rotatable tip 80 to the de-clog orientation and can cause AMS 12 to eject the clog. After the clog is ejected, controller 74 maneuvers AMS 12 back to the spraying position, and nozzle 40 is realigned to begin spraying at the same location as when the clog was detected.

In some examples, controller 74 is configured to deactivate spraying based on a variety of factors undergoing an unexpected change. Spray effectiveness is depending on fluid pressure, distance X between nozzle 40 and surface 68, and the sweep speed of nozzle 40 relative to surface 68. An unexpected change in those parameters can degrade spray quality. As such, controller 74 immediately ceases spraying, such as by deactivating pump motor 104 and/or closing spray valve 68, based on the unexpected change in the fluid pressure.

In some examples, controller 74 ceases spraying when the supply of fluid in reservoir 56 reaches a refill level, which can cause a drop in fluid pressure. The level of fluid remaining in reservoir 56 can be monitored by a fluid level monitor, such as a float sensor (not shown), and communicated to controller 74. In another example, a sensor can be configured to sense the presence of fluid in inlet tube 110, such as two separated terminals that measure for electrical connectivity therebetween to confirm the presence of fluid. If no fluid is detected, then controller 74 knows that reservoir 56 requires refill. In other examples, fluid sensor 78 can indicate a drop in pressure below a minimum spray pressure or a change in pressure by more than a threshold amount. Speed sensor 108 can sense an increase or decrease in the speed of pump motor 104, either of which cause controller 74 to cease spraying where the change is unexpected. For example, the increase in the speed of pump motor 104 can indicate a clog in nozzle 40 or a lack of fluid in reservoir 56. As discussed above, controller 20 can also stop spraying where unexpected movement is sensed by a sensor, such as an inertial sensor.

AMS 12 provides significant advantages. AMS 12 can operate autonomously, saving time and energy of the user. Controller 74 includes software configured to maintain AMS 12 in the desired spraying position throughout the spray process. Maintaining AMS 12 in the desired spray position provides a high quality, even finish on the surface. In addition, controller 74 compensates for unexpected events, such as movement or acceleration, to ensure that AMS 12 applies a high quality finish at the desired locations. Controller 74 recognizes unexpected acceleration of AMS 12 and deactivates spraying in response to unexpected acceleration, thereby preventing AMS 12 from spraying fluid on undesired surfaces or at undesired locations. Controller 74 further automatically detects and ejects clogs that can adversely impact the spray operation. Controller 74 also recognizes unexpected fluctuations in fluid pressure and can automatically cease spraying when the unexpected fluctuation is detected. In addition, the distance between nozzle 40 and surface 62 can be finely adjusted. Controller 74 maneuvers AMS 12 to the desired spray position and utilizes linear actuator 70 to finely adjust the distance. Screen 72 allows AMS 12 to remain in the same position when nozzle 40 is de-clogged, saving time and energy during the de-clog procedure. Slack 86 in internal supply line 64 allows spray tube 42 to move longitudinally and to rotate relative to applicator arm 38. Speed sensor 108 provides direct feedback to controller 74 regarding pump 58.

FIG. 3A is an isometric view of nozzle 40, spray tube 42, and de-clog mechanism 66. FIG. 3B is a cross-sectional view of nozzle 40, spray tube 42, and de-clog mechanism 66 taken along line 3-3 in FIG. 3A. FIGS. 3A and 3B will be discussed together. Spray tube 42 includes spray valve 68, and spray valve 68 includes needle 94, spring 124, and seat 126. Nozzle 40 includes rotatable tip 80, orifice 128, and tip bore 130. Rotatable tip 80 includes barrel 82 and tip gear 84. Orifice 128 includes first end 132 and second end 134. De-clog mechanism 66 includes de-clog motor 88 and de-clog gear 90.

Spray valve 68 is disposed within spray tube 42 and is configured to control the flow of fluid out of spray tube 42 and to nozzle 40. Needle 94 interfaces with and is seated on seat 126 when spray valve 68 is in the closed position, and needle 94 is retracted from seat when spray valve 68 is in the open position. Needle 94 extends to an actuator, such as valve actuator 92 (FIG. 2A), and the actuator controls needle 94 open, closed, or both. Spring 124 is disposed around needle 94 and is configured to shift needle 94 to the closed position, such that spray valve 68 is normally closed.

Nozzle 40 is mounted on spray tube 42. Rotatable tip 80 extends into tip bore 130 through nozzle 40 and can be rotated between a spraying position and an opposite, de-clog position. Barrel 82 is elongate and is disposed in tip bore 130. Tip gear 84 is disposed at the distal end of barrel 82 and can project outside of tip bore 130. Orifice 128 is disposed in barrel 82 of rotatable tip 80. In some examples, orifice 128 is a removable piece separable from barrel 82. In other examples, orifice 128 is integrally formed with barrel 82. First end 132 of orifice 128 is configured to generate the spray fan, and second end 134 of orifice 128 is configured to blow out a tip clog. The opening through first end 132 is narrower than the opening through second end 134. With rotatable tip 80 in the spraying position, shown in FIG. 3B, first end 132 points out of nozzle 40, and all fluid exits nozzle 40 through first end 132 of orifice 128. First end 132 atomizes the fluid and generates a spray fan to apply the fluid to the surface. For example, first end 132 can have a cat-eye shape to produce a relatively flat spray fan. In some examples, the cat-eye shape can include a relatively flat long side to produce a flatter, sharper spray fan. With rotatable tip 80 in the de-clog position, second end 134 of orifice faces outward from nozzle 40, and the fluid exits spray tube 42 and nozzle 40 through second end 134. The opening through second end 134 is larger than the opening through first end 132, such that any debris or build-up of material that would generate a clog at first end 132 can pass through second end 134 with rotatable tip 80 in the de-clog position.

De-clog mechanism 66 is mounted on spray tube 42 and is configured to rotate rotatable tip 80 between the spraying position and the de-clog position. De-clog motor 88 is mounted on spray tube 42 and is connected to a power source, such as power source 76, by wire 135. De-clog gear 90 is rotatably driven by de-clog motor 88. De-clog gear 90 interfaces with tip gear 84 and is configured to drive the rotation of rotatable tip 80. De-clog motor 88 can be a stepper motor or a pneumatic motor, among other examples.

During operation, fluid and other debris can build up within orifice 128 and create a clog. The clog must be removed before continuing to spray. In response to the clog, rotatable tip 80 is rotated from the spraying position, where first end 132 of orifice 128 faces outwards, to the de-clog position, where second end 134 of orifice 128 faces outwards. The fluid pressure within spray tube 42 ejects the clog from orifice 128 through second end 134.

When the clog is detected, a de-clog command is provided to de-clog motor 88 through wire 135. For example, the de-clog command can be an electrical signal causing de-clog motor 88 to activate. The de-clog command can also cause spray valve 68 to shift to the closed position to cut off flow through nozzle 40. As such, the de-clog command stops flow through spray valve 68 and causes de-clog mechanism 66 to rotate rotatable tip 80 to the de-clog position. De-clog motor 88 activates and drives de-clog gear 90. De-clog gear 90 rotates tip gear 84 and thus rotatable tip 80 to the de-clog position. AMS 12 is repositioned such that nozzle 40 faces away from surface 62 and/or a screen, such as screen 72 (FIG. 2A) is positioned between nozzle 40 and the surface to prevent the clog from blowing onto surface 62. With rotatable tip 80 in the de-clog position, spray valve 68 shifts to the open position and the fluid pressure blows the clog out of second end 134 of orifice 128. With the clog ejected, spray valve 68 recloses the flow path through spray tube 42, and de-clog mechanism 66 rotates rotatable tip 80 back to the spraying position. Nozzle 40 is thus ready to continue spraying.

As discussed above, AMS 12 can automatically detect a clog and can automatically initiate the de-clog routine. For example, a rise in fluid pressure downstream of the pump can be detected by a sensor, such as fluid sensor 78 (FIG. 2A), which indicates that the fluid is not being released downstream through nozzle 40. In some examples, a camera can detect the presence and quality of the spray fan produced by orifice 128. An alteration of the spray fan can indicate a tip clog. In some examples, a decrease in the speed of the pump motor, such as pump motor 104 (FIG. 2A), can be detected by a sensor, such as speed sensor 108 (FIG. 2A). In other examples, an increase in strain on drive 106 (FIG. 2A) can indicate the presence of a tip clog. When a tip clog is detected, the de-clog procedure can be automatically initiated by controller 74. The user can also initiate the de-clog procedure. For example, the user can input a de-clog command into a user interface to initiate the de-clog routine. The ejection of the clog can similarly be automatically detected by AMS. For example, the ejection of the clog can be confirmed by a sudden drop in fluid pressure downstream of the pump, by a camera configured to detect the presence and quality of the spray fan, by a decrease in strain on drive 106; and/or by an increase in the speed of pump motor 104. With the clog ejected, AMS 12 automatically resumes spraying.

Where a clog is detected, an alarm can automatically be generated to inform the user of the issue. For example, AMS 12 can generate an audio alarm, where AMS 12 includes speakers (not shown); a visual alarm, such as lights; or an electronic message, such as a communication provided to the user via the user interface (not shown).

Nozzle 40 provides significant advantages. Rotatable tip 80 is rotatable between the spraying position and the de-clog position, allowing clogs to be blown out of orifice 128. De-clog mechanism 66 engages tip gear 84 and drives rotatable tip 80 between the spraying position and the de-clog position. De-clog mechanism 66 allows clogs to be automatically blown out of orifice 128 during spraying, saving time and increasing the efficiency of the spray process.

Figure 4B:
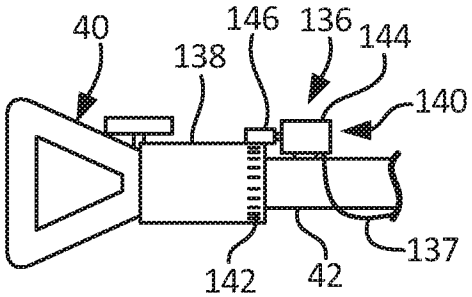
FIG. 4B is a side elevation view of a spray tube in a vertical fan orientation.
Figure 4A:
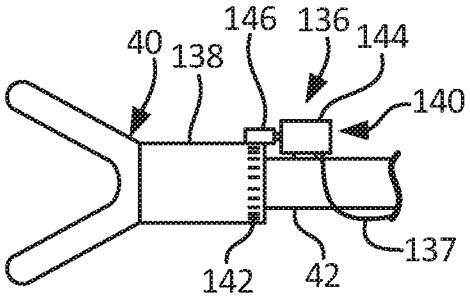
FIG. 4A is a side elevation view of a spray tube in a horizontal fan orientation.
Figure 4E:
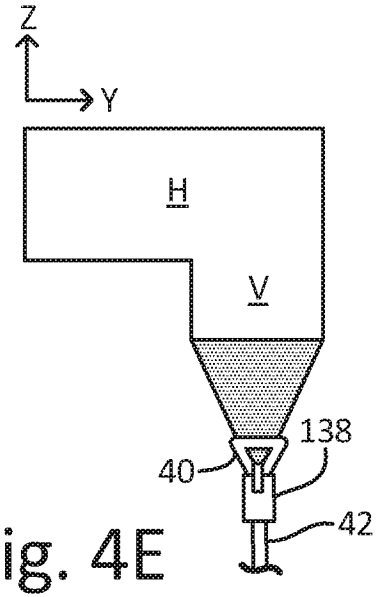
FIG. 4E is a perspective view of a spray tube applying a spray fan while in the vertical fan orientation shown in FIG. 4B.
Figure 4D:
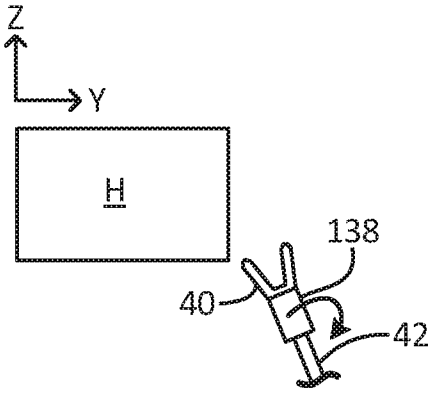
FIG. 4D is a perspective view of a spray tube with the spray fan in an intermediate orientation.
Figure 4C:
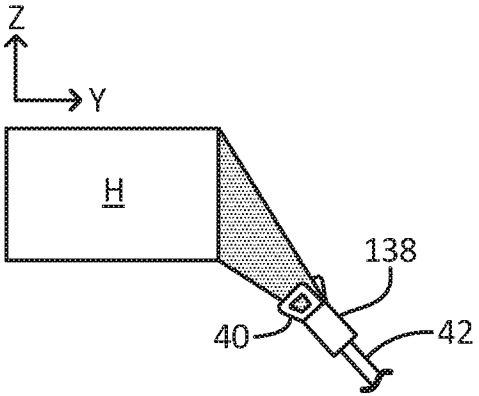
FIG. 4C is a perspective view of a spray tube applying a spray fan while in the horizontal fan orientation shown in FIG. 4A.

FIG. 4A is a side elevation view of fan rotating assembly 136 with nozzle 40 in a horizontal fan orientation. FIG. 4B is a side elevation view of fan rotating assembly 136 with nozzle 40 in a vertical fan orientation. FIG. 4C is a perspective view of nozzle 40 applying a spray fan while in the vertical fan orientation in which the width of the spray fan (e.g., the largest dimension of the spray fan as the spray fan intersects with the wall) is oriented vertically along the Z axis while a thickness of the spray fan (smaller than the width) is oriented horizontally along the Y axis. The width dimension of the spray fan is orientated orthogonal with respect to the thickness dimension of the spray fan. Sweeps of the nozzle 40 are typically made with the width of the spray fan defining the width of the stripe being sprayed on the wall while the nozzle 40 is moved in the sweeping motion parallel to the orientation of the thickness dimension. FIG. 4D is a perspective view of nozzle 40 in an intermediate orientation. FIG. 4E is a perspective view of nozzle 40 applying a spray fan while in the horizontal fan orientation in which the width of the spray fan is oriented horizontally along the Y axis while a thickness of the spray fan is oriented vertically along the Z axis. FIGS. 4A-4E will be discussed together.

Fan rotating assembly 136 includes sleeve 138 and nozzle rotator 140. Sleeve 138 includes teeth 142. Nozzle rotator 140 includes rotation motor 144 and pinion 146. Teeth 142 extend at least partially around sleeve 138. In some examples, teeth extend at least 90° around sleeve 138. Nozzle rotator 140 is configured to rotate sleeve 138, and thus nozzle 40, between the horizontal fan orientation, used for vertical spray passes, and the vertical fan orientation, used for horizontal spray passes. Rotation motor 144 is mounted on spray tube 42 and can be any suitable motor for driving the rotation of sleeve 138, such as a stepper motor or a pneumatic motor. Pinion 146 extends from rotation motor 144 and interfaces with teeth 142 on sleeve 138. Rotation motor 144 is connected to a power source, such as power source 76 (FIG. 2A), by wire 137.

Nozzle 40 is fluidly connected to spray tube 42 and is configured to receive fluid from spray tube 42. Sleeve 138 extends between and connects nozzle 40 and spray tube 42. Nozzle 40 is attached to sleeve 138, and sleeve 138 is attached to spray tube 42. A rotatable, sealed joint is disposed at the interface of sleeve 138 and spray tube 42, such that sleeve 138 can rotate relative to spray tube 42.

During operation, AMS 12 can apply fluid using both horizontal spray fans and vertical spray fans. The orientation of a spray fan is based on an orientation of the elongate sides of the spray fan. As shown in FIG. 4C, AMS 12 applies vertical spray fans when nozzle 40 moves laterally relative to the surface. For example, where nozzle 40 is held at a steady vertical position and AMS 12 moves laterally via wheels 22. As shown in FIG. 4E, AMS 12 applies horizontal spray fans when nozzle 40 moves vertically relative to the surface. For example, where nozzle 40 maintains a steady lateral position and applicator arm 38 (best seen in FIGS. 1C and 2A) moves vertically relative to surface 62. As such, the spray fan is oriented orthogonal to the direction of travel of nozzle 40.

A spray event where nozzle 40 paints a corner will be discussed as an example. Nozzle 40 is initially in the vertical spray orientation (FIGS. 4B and 4C). The fluid is driven to nozzle 40 under pressure, and nozzle 40 generates the vertical spray fan. AMS 12 travels horizontally along the surface to apply the horizontal stripe. For example, wheel motors 24 (FIG. 1B) drive wheels 22 to cause lateral displacement of AMS 12 and nozzle 40. When AMS 12 reaches the end of horizontal stripe H, nozzle 40 must be reoriented to the horizontal spray orientation (FIGS. 4A and 4E) to apply vertical stripe V. Nozzle rotator 140 is activated by providing power to rotation motor 144 via wire 137. Rotation motor 144 drives pinion 146, and pinion 146 in turn causes sleeve 138 to rotate relative to spray tube 42 due to pinion 146 interfacing with teeth 142. As shown in FIG. 4D, sleeve 138 and nozzle 40 rotate relative to spray tube 42, and nozzle 40 transitions from the vertical spray orientation to the horizontal spray orientation. With nozzle 40 in the horizontal fan orientation, spraying is recommenced. Applicator arm 38 moves vertically relative to the surface and applies vertical stripe V.

Fan rotating assembly 136 provides significant advantages. Fan rotating assembly 136 allows AMS 12 to automatically change the fan orientation during operation. As such, AMS 12 can apply both vertical stripe V and horizontal stripe H without requiring the user to change nozzles and/or spray tips. In addition, AMS 12 is able to paint corners by utilizing both the horizontal fan orientation and the vertical fan orientation. Fan rotating assembly 136 ensures that the spray fan can be oriented orthogonal to the direction of travel of nozzle 40, regardless of that direction of travel.

Figure 5:
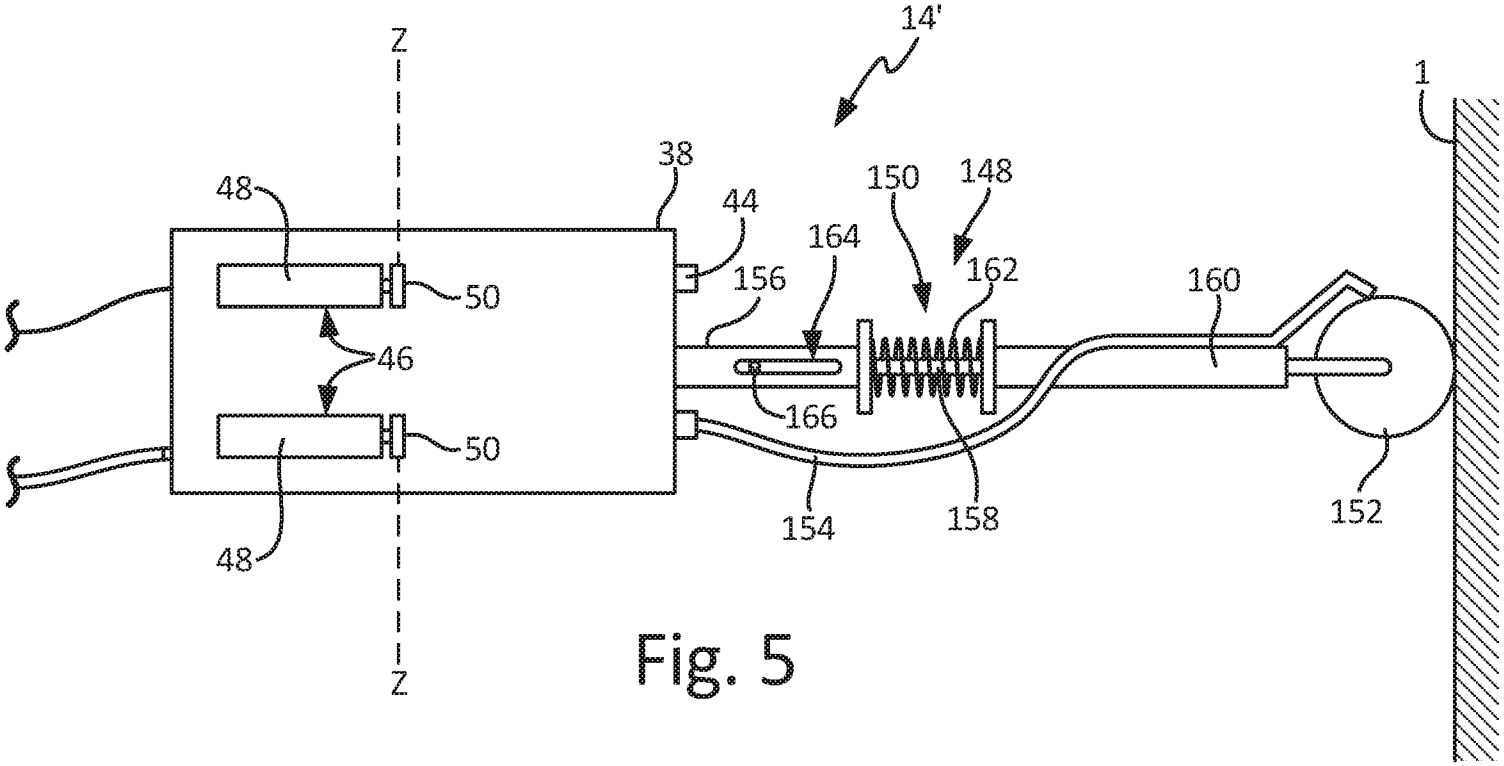
FIG. 5 is a side elevation view of a movable applicator assembly.

FIG. 5 is a side elevation view of applicator assembly 14'. Applicator assembly 14' includes applicator arm 38, sensor 44, applicator drives 46, and roller assembly 148. Applicator drives 46 includes drive motors 48 and drive gears 50. Roller assembly 148 includes roller arm 150, fluid roller 152, and roller tube 154. Roller arm 150 includes outer member 156, inner member 158, extended member 160, and roller spring 162. Outer member 156 includes slot 164, and inner member 158 includes pin 166.

Applicator arm 38 is mounted on frame 20 (FIGS. 1A-1C). Applicator drives 46 are mounted on applicator arm 38 and are configured to drive movement of applicator arm 38. Drive motors 48 are connected to and rotate drive gears 50. Drive gears 50 are configured to engage frame 20 to cause vertical displacement of applicator arm 38 along vertical axis Z-Z. For example, drive gears 50 can engage frame 20 in a rack and pinion configuration. Drive gears 50 are aligned on a center of mass of applicator arm 38, through which vertical axis Z-Z extends, thereby providing increased stability and balance to applicator arm 38. Sensor 44 is supported by applicator arm 38 and is configured to provide information to a controller, such as controller 74 (FIG. 2A). Sensor 44 can include any one or more of a distance sensor, a location sensor, an optical sensor, and/or an inertial sensor.

Roller arm 150 extends from applicator arm 38 towards surface 62. Outer member 156 is attached to applicator arm 38 and extends from applicator arm 38 towards surface 62. Outer member 156 is at least partially hollow, and slot 164 extends through outer member 156. Inner member 158 is slidably disposed within outer member 156. Pin 166 extends from inner member 158 and is disposed in slot 164. Pin 166 extending into slot 164 allows inner member 158 to slide relative to outer member 156 along the longitudinal axis X-X, while pin 166 and slot 164 prevent inner member 158 from rotating relative to outer member 156. Extended member 160 is fixed to inner member 158 and extends towards surface 62 from extended member 160. Roller spring 162 extends around inner member 158 and is disposed between outer member 156 and extended member 160. Fluid roller 152 is mounted at an end of extended member 160 opposite inner member 158, and fluid roller 152 contacts surface 62. Fluid roller 152 can be any suitable roller for applying fluid to a surface, such as a conventional paint roller. Roller tube 154 extends from applicator arm 38 to fluid roller 152 and is configured to provide a supply of fluid to fluid roller 152 for application to surface 62. For example, roller tube 154 can include a nozzle fitting for spraying the fluid onto fluid roller 152. Supply hose 60 extends to applicator arm 38 from a fluid supply system, such as fluid supply 16 (FIGS. 1A and 2A). Supply hose 60 is fluidly connected to roller tube 154, such that supply hose 60 provides fluid to roller tube 154 and thus to fluid roller 152.

During operation, applicator arm 38 is positioned such that fluid roller 152 contacts surface 62. Applicator drive 46 displaces applicator arm 38 vertically along axis Z-Z, thereby causing fluid roller 152 to roll on surface 62 and deposit fluid on surface 62. Supply hose 60 provides fluid to applicator arm 38, and roller tube 154 provides the fluid to fluid roller 152. Fluid roller 152 applies the fluid received from roller tube 154 onto surface 62.

Roller arm 150 maintains fluid roller 152 in contact with surface 62 throughout fluid application. Roller spring 162 pushes extended member 160 towards surface 62 and exerts a force on extended member 160 to maintain fluid roller 152 in contact with surface 62. For example, roller spring 162 can be configured to generate about 3-10 pounds of force. As such, fluid roller 152 maintains contact with surface 62 even if applicator arm 38 displaces longitudinally relative to surface 62 along axis X-X. In examples where applicator arm 38 displaces towards surface 62, inner member 158 slides further into outer member 156 to account for the displacement, preventing fluid roller 152 from exerting excess pressure on surface. As inner member 158 slides into outer member 156 roller spring 162 is compressed between outer member 156 and extended member 160. In examples where applicator arm 38 displaces away from surface 62, roller spring 162 pushes extended member 160 away from outer member 156 and towards surface 62 to maintain fluid roller 152 in contact with surface 62.

In some examples, roller arm 150 can form a support arm of a wall support, such as support arm 52 (best seen in FIG. 1B) of wall support 36 (best seen in FIG. 1B). For example, a support roller, such as support roller 54 (best seen in FIG. 1B), can be mounted on extended member 160 in place of fluid roller 122. With inner member 158, outer member 156, and extended member 160 supporting the support roller, the wall support provides limited movement between the frame of AMS 12, such as frame 20 (FIGS. 1A-1B), and surface 62. The wall support thus provides a cushioning effect between AMS 12 and surface 62. In some examples, an encoder can be placed on roller arm 150 as part of the wall support, such as over slot 164. The encoder provides information to a controller, such as controller 74 (FIG. 2A), regarding the degree of movement between outer member 156 and inner member 158. Based on that information, controller 74 can dynamically adjust a spray parameter to maintain a consistent finish on surface 62. For example, the controller 74 can decrease the speed of a pump motor, such as pump motor 104 (FIG. 2A), to decrease the spray fan width where the encoder indicates movement towards surface 62, among other options.

Applicator assembly 14' provides significant advantages. Applicator assembly 14' applies the fluid directly to surface 62 with fluid roller 152, reducing the overall volume of fluid required to coat surface 62. Roller spring 162 maintains fluid roller 152 in contact with surface 62 and provides sufficient pressure on fluid roller 152 to ensure a quality finish. Roller arm 150 provides limited relative longitudinal movement between applicator arm 38 and fluid roller 152, preventing applicator arm 38 from exerting undesired pressure on fluid roller 152. Slot 164 and pin 166 allow inner member 158 to slide longitudinally within outer member 156 while preventing relative rotation between inner member 158 and outer member 156. Drive gears 50 are aligned with the vertical axis through the center of mass of applicator arm 38, thereby balancing applicator arm 38 on frame 20. In addition, applicator arm 38 is modular such that applicator arm 38 can receive and support both nozzle 40 and roller assembly 148. As such, a single applicator arm 38 can be utilized across multiple applications.

Figure 6:
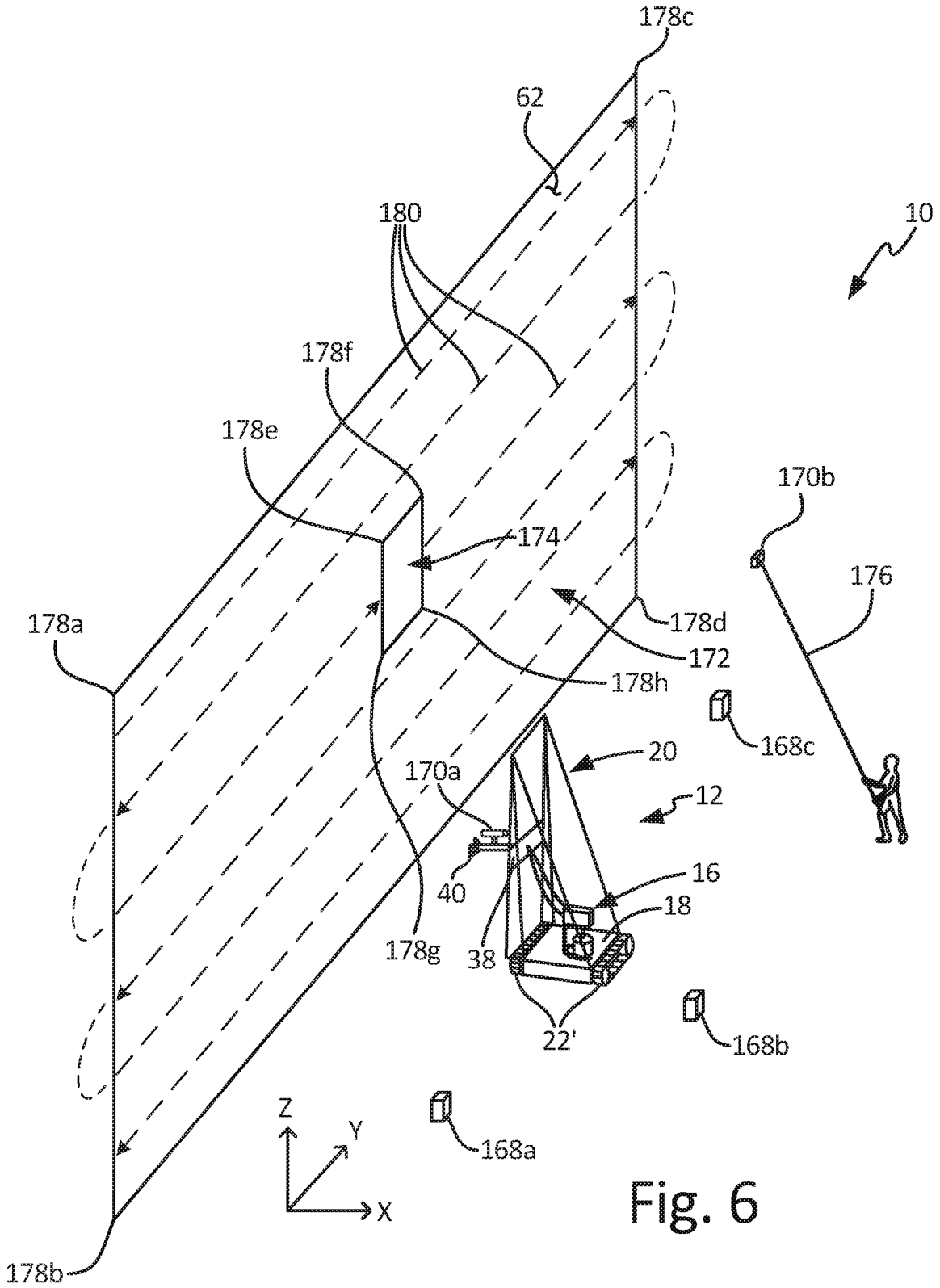
FIG. 6 is a simplified schematic diagram of an automated surface profiling and painting system.

FIG. 6 is a simplified schematic diagram of automated surface profiling and spray system 10. Automated surface profiling and spray system 10 includes AMS 12, fluid supply 16, surface 62, stationary nodes 168*a*-168*c* (collectively herein "stationary node 168"), mobile nodes 170*a*-170*b* (collectively herein "mobile node 170"). Base 18, frame 20, tracks 22', applicator arm 38, and nozzle 40 of AMS 12 are shown. Nozzle 40 includes mobile node 170*a*. AMS 12 is simplified, but it is understood that AMS 12 can include any of the components described herein. Surface 62 includes spray area 172 and non-spray area 174.

Surface 62 is a surface to be sprayed with fluid by AMS 12. Spray area 172 is an area of surface 62 onto which the fluid is to be applied, such as a wall, for example. Non-spray area 174 is an area of surface 62 onto which no fluid is to be applied, such as a window, for example. Base 18 supports various components of AMS 12. Tracks 22' are attached to base 18 and provide locomotion to AMS 12. Frame 20 is mounted on base 18. Applicator arm 38 is attached to frame 20 and can shift vertically relative to frame 20. Nozzle 40 extends from applicator arm 38 and is configured to generate a spray fan of fluid for application to spray area 172 of surface 62. Fluid supply 16 is supported by base 18 such that fluid supply 16 travels with AMS 12. While fluid supply 16 is shown as supported by base 18, it is understood that fluid supply 16 can be located off of base 18 and connected to AMS 12 via a supply tube, such as supply hose 60 (best seen in FIG. 1A). Fluid supply 16 stores the fluid and pressurizes and drives the fluid to nozzle 40. Fluid supply 16 is configured to generate sufficient pressure to cause nozzle 40 to atomize the fluid and generate the spray fan (about 500-4,000 psi).

Location and mapping are achieved by stationary nodes 168 and mobile nodes 170. Mobile node 170*a* is mounted on AMS 12 proximate nozzle 40. In some examples, mobile node 170*a* is mounted on nozzle 40 or on a spray tube, such as spray tube 42 (best seen in FIG. 2A), extending between applicator arm 38 and nozzle 40. Mobile node 170*b* is disposed at an end of pole 176, which the user manipulates to mark the locations of boundary points 178. Stationary nodes 168 are placed at desired locations relative to surface 62. Stationary nodes 168 transmit and/or receive signals, such as RF, ultrasonic, and/or optical signals, among other options. Each stationary node 168 can determine the relative separation in three-dimensional space between itself and other stationary nodes 168 and mobile nodes 170. The user can communicate with stationary nodes 168, mobile nodes 170, and AMS 12 via a user interface.

Prior to spraying, spray areas 172 and non-spray areas 174 of surface 62 are defined, and raster lines 180 are assigned to guide AMS 12 during spraying. Boundary points 178 are marked to define spray area 172 and non-spray area 174. In a setup phase, stationary nodes 168 are placed and activated. Stationary nodes 168 locate other stationary nodes 168 and establish a three-dimensional network grid in the work space. The user positions mobile node 170*b* at desired locations to designate boundary points 178. For example, the user uses pole 176 to position mobile node 170*b* and presses a button on the user interface and/or pole 176 to record the location of mobile node 170*b* as a boundary point 178. The coordinate location of mobile node 170*b* is recorded in a memory, such as memory 100 (FIG. 2A).

In some examples, two types of boundary points can be marked: inclusion points, such as boundary points 178*a*-178*d*, and exclusion points, such as boundary points 178*e*-178*h*. The user marks the corners and defines the boundary of spray area 172 with inclusion points 178*a*-178*d*. The user then marks the corners and defines the boundary of non-spray area 174, which is within the plane of the spray area 172, with exclusion points 178*e*-178*h*. For example, the user can position mobile node 170*b* at the corners of surface 62, and marks each as an inclusion point 178*a*-178*d*. The user positions mobile node 170*b* at the corners of non-spray area 174, marking each as an exclusion point. The user indicates via the user interface which type of node is going to be marked next, either an exclusion or inclusion point. Control circuitry, such as controller 74 (FIG. 2A), can interpolate from the inclusion points and exclusion points and digitally define the surface to be sprayed, spray area 172, based on the inclusion points while excluding portions not to be sprayed, non-spray area 174, based on the exclusion points. For example, the program can define a bounded plane based on all of the inclusion points being at the corners of the bounded plane. Exclusion planes can similarly be defined from exclusion points and then deleted from the bounded plane.

In some examples, boundary points 178 are marked when mobile node 170*b* is at or near a desired spray distance from surface 62. As such, the control circuitry of AMS 12 recognizes that AMS 12 is at a desired spray distance when mobile node 170*a* indicates that AMS 12 is at the same distance from surface 62 as when boundary points 178 were marked.

With boundary points 178 assigned, a spray plan is automatically generated by the controller. For example, the controller can assign raster lines 180 (e.g., horizontal or vertical lines) over the bounded plane defining surface 62. Each raster line 180 corresponds to one pass of spraying by AMS 12. In some examples, the height of each raster line 180 corresponds to a standard height or width of the spray fan. Each raster line 180 is set so that each part of spray surface 62 is covered by the spray generated when AMS 12 follows raster lines 180. In some examples, each raster line 180 corresponds to one half of the standard height or width of the spray fan, providing 50% overlap such that each area of surface 62 is coated twice. It is understood, however, that raster lines 180 can be assigned to provide any desired degree of overlap. In some examples, the user can determine the degree of overlap via the user interface.

Raster lines 180 are assigned three dimensional coordinates within the bounded plane, the controller generates a spray plan including pathways along raster lines 180, and the controller further defines spray "on" and spray "off" times during which the fluid is sprayed or not sprayed from nozzle 40. For example, the controller defines spray "on" when nozzle 40 is located within the boundary defined by inclusion points 178*a*-178*d*, as indicated by the position of mobile node 170*a*, but outside of the boundary defined by exclusion points 178*e*-178*h*. Similarly, the controller defines spray "off" as when nozzle 40 is located within the boundary defined by exclusion points 178*e*-178*h*, as indicated by the position of mobile node 170*a*, or outside of the boundary defined by inclusion points 178*a*-178*d*.

With the spray plan defined, AMS 12 automatically maneuvers within the three dimensional coordinate space to position mobile node 170*a* at a desired spray start location. Because mobile node 170*a* is mounted proximate nozzle 40, the location of mobile node 170*a* indicates the location of nozzle 40 within the three dimensional coordinate space. AMS 12 sprays the fluid on spray surface 62 following the coordinate pathways and spraying or not spraying per the spray plan. When AMS 12 reaches the end of each raster line 180, AMS 12 shifts applicator arm 38 vertically to the next raster line 180 and reverses course along surface 62 to apply a new stripe of fluid. AMS 12 sprays spray surface 62 and automatically stops spraying as nozzle 40 passes over non-spray surface 62. While the flight/spray plan is described as including horizontal raster lines 180, it is understood that the flight/spray plan can also generate and cause AMS 12 to follow vertical raster lines. In some examples, mobile node 170*a* and mobile node 170*b* can be placed at a common location and "zeroed." The controller then controls spraying and movement of AMS 12 based on inertial navigation, such as based on information from an accelerometer and/or gyroscope.

Although the present invention has been described with reference to preferred embodiments, workers skilled in the art will recognize that changes may be made in form and detail without departing from the spirit and scope of the invention.

The invention claimed is:

1. An automated mobile sprayer (AMS) for spraying a fluid on a wall, the AMS comprising:

a mobile base comprising a plurality of wheels or tracks and one or more first motors configured to move the mobile base via the plurality of wheels or tracks along a ground surface and laterally relative to the wall;

a support mounted to the mobile base;

an applicator arm supported vertically above the mobile base by the support, wherein the applicator arm is movable along a vertical axis, and wherein the support prevents the applicator arm from moving laterally or longitudinally relative to the support during spraying;

a second motor configured to move the applicator arm vertically along the vertical axis;

a nozzle connected to the applicator arm and configured to spray the fluid;

a first sensor supported by the mobile base, the first sensor disposed at a first orientation to sense a first distance, the first distance being a distance between the wall and the first sensor;

a second sensor supported by the mobile base, the second sensor disposed at a second orientation to sense a second distance, the second distance being a distance between the wall and the second sensor; and a controller for causing the AMS to spray a plurality of vertical stripes of the fluid on the wall, the controller configured to:

control the second motor to move the applicator arm vertically along the vertical axis in a continuous motion between an upper position and a lower position for spraying each of the plurality of vertical stripes, control spray of the fluid from the nozzle for spraying each of the plurality of vertical stripes, receive distance information from the first sensor and the second sensor, control the one or more first motors based on the first distance and the second distance to move the mobile base along the wall between spraying adjacent ones of the plurality of vertical stripes, and control, for each vertical stripe of the plurality of vertical stripes, the one or more first motors to reposition the nozzle, by repositioning the mobile base, to an orientation relative to the wall for spraying the vertical stripes based on the first distance and the second distance.

2. The AMS of claim 1, wherein the first sensor and the second sensor are laterally offset from the nozzle such that the nozzle is disposed laterally between the first sensor and the second sensor.

3. The AMS of claim 2, wherein the first sensor and the second sensor are located laterally equidistant from the nozzle.

4. The AMS of claim 1, wherein the controller is configured to determine a sensed nozzle orientation based on a comparison of the first distance and the second distance.

5. The AMS of claim 1, wherein the controller is configured to:

determine a sensed nozzle orientation relative to the wall based on the first distance and the second distance, and for the spraying of each vertical stripe of the plurality of stripes, control the one or more first motors to reposition the mobile base until the sensed nozzle orientation corresponds with a desired nozzle orientation.

6. The AMS of claim 5, wherein the controller further comprises memory, wherein the controller is configured to recall the desired orientation in from the memory, and wherein the desired orientation is preloaded in the memory.

7. The AMS of claim 6, wherein the controller is configured to determine that the nozzle is in the desired orientation based on the nozzle being orthogonal relative to the wall.

8. The AMS of claim 5, wherein the controller is configured to control the one or more first motors to maintain the sensed nozzle orientation as corresponding to the desired nozzle orientation during the spraying of each vertical stripe of the plurality of vertical stripes.

9. The AMS of claim 5, wherein the controller is configured to determine that the sensed nozzle orientation corresponds to the desired orientation when the first distance is equal to the second distance.

10. The AMS of claim 5, wherein the controller is configured to, when spraying a vertical stripe of the plurality of vertical stripes, stop spraying from the nozzle based on the sensed nozzle orientation differing from the desired nozzle orientation.

11. The AMS of claim 1, wherein the controller is configured to determine that the nozzle is in the orientation relative to the wall for spraying based on an angle of the nozzle relative to the wall.

12. The AMS of claim 1, wherein the controller is configured to determine that the nozzle is in the orientation relative to the wall for spraying based on the nozzle being orthogonal relative to the wall.

13. The AMS of claim 1, wherein the first sensor and the second sensor are mounted on the applicator arm.

14. The AMS of claim 1, further comprising a valve actuator mounted on the applicator arm, the valve actuator configured to be controlled by the controller to initiate and cease spray of the fluid from the nozzle.

15. The AMS of claim 1, wherein the first sensor is a first ultrasonic sensor and the second sensor is a second ultrasonic sensor.

16. The AMS of claim 1, wherein the nozzle is configured to spray each vertical stripe of the plurality of vertical stripes with a horizontal spray fan of the fluid.

17. The AMS of claim 1, wherein the controller is configured to, for each vertical stripe of the plurality of vertical stripes:

determine a sensed distance based on one or both of the first distance and the second distance, and control the one or more first motors to reposition the nozzle relative to the wall until the sensed distance corresponds to a preloaded distance for spraying the vertical stripe.

18. The AMS of claim 1, wherein the controller is configured to receive an overlap parameter corresponding to a degree of overlap of the plurality of vertical stripes, and the controller is configured to control the one or more first motors to move the mobile base along the wall between spraying the plurality of vertical stripes based on the overlap parameter so that the plurality of vertical stripes overlap to the degree of the overlap parameter.

19. A spray system, the spray system comprising the AMS of claim 1 and a fluid supply disposed off-board of the mobile base, the fluid supply comprising a pump and a supply hose between the pump to the AMS to supply the fluid for spraying from the nozzle.

20. The AMS of claim 1, wherein the support includes a first vertical support and a second vertical support, and wherein the applicator arm is disposed between the first vertical support and the second vertical support.

21. The AMS of claim 20, wherein the applicator arm is supported by the first vertical support and the second vertical support such that the applicator arm can move vertically relative to the first vertical support and the second vertical support while spraying, and the applicator arm is prevented from moving laterally or longitudinally relative to the first vertical support and the second vertical support while spraying.

22. The AMS of claim 1, wherein the first orientation is the same as the second orientation.

23. The AMS of claim 1, wherein at least one of the first sensor and the second sensor is a proximity sensor, a radar transducer, an ultrasonic rangefinder, an acoustic rangefinder, a laser rangefinder, radar, or lidar.

24. An automated mobile sprayer (AMS) for spraying a fluid on a wall, the AMS comprising:

a mobile base comprising a plurality of wheels or tracks and one or more first motors configured to move the mobile base via the plurality of wheels or tracks along a ground surface and laterally relative to the wall;

a support mounted to the mobile base, wherein the support includes a first vertical support and a second vertical support;

an applicator arm supported vertically above the mobile base by the support, the applicator arm movable along a vertical axis, wherein the applicator arm is supported by the first vertical support and the second vertical support such that the applicator arm can move vertically relative to the first vertical support and the second vertical support while spraying, and the applicator arm is prevented from moving laterally or longitudinally relative to the first vertical support and the second vertical support while spraying;

a second motor configured to move the applicator arm vertically along the vertical axis;

a nozzle connected to the applicator arm and configured to spray the fluid;

a first sensor supported by the mobile base and configured to sense a first distance, the first distance being a distance between the wall and the first sensor;

a second sensor supported by the mobile base and configured to sense a second distance, the second distance being a distance between the wall and the second sensor; and a controller for causing the AMS to spray a plurality of vertical stripes of the fluid on the wall, the controller configured to:

control the second motor to move the applicator arm vertically along the vertical axis for spraying each of the plurality of vertical stripes, control spray of the fluid from the nozzle for spraying each of the plurality of vertical stripes, receive distance information from the first sensor and the second sensor, control the one or more first motors based on the first distance and the second distance to move the mobile base along the wall between spraying adjacent ones of the plurality of vertical stripes, and control, for each vertical stripe of the plurality of vertical stripes, the one or more first motors to reposition the nozzle, by repositioning the mobile base, to an orientation relative to the wall for spraying the vertical stripes based on the first distance and the second distance.

* * * * *